US010520844B2

(12) United States Patent
Nozaki

(10) Patent No.: US 10,520,844 B2
(45) Date of Patent: Dec. 31, 2019

(54) TONER, IMAGE FORMING APPARATUS, AND IMAGE FORMING METHOD

(71) Applicant: KYOCERA Document Solutions Inc., Osaka (JP)

(72) Inventor: Takatoshi Nozaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/259,461

(22) Filed: Jan. 28, 2019

(65) Prior Publication Data

US 2019/0243270 A1 Aug. 8, 2019

(30) Foreign Application Priority Data

Feb. 6, 2018 (JP) ..... 2018-019061

(51) Int. Cl.
*G03G 9/08* (2006.01)
*G03G 9/093* (2006.01)
*G03G 9/097* (2006.01)

(52) U.S. Cl.
CPC ..... *G03G 9/09364* (2013.01); *G03G 9/0825* (2013.01); *G03G 9/097* (2013.01); *G03G 9/09328* (2013.01); *G03G 9/09371* (2013.01); *G03G 9/09378* (2013.01); *G03G 9/09392* (2013.01)

(58) Field of Classification Search
CPC ..... G03G 9/09364
USPC ..... 430/110.2
See application file for complete search history.

(56) References Cited

U.S. PATENT DOCUMENTS 6,495,301 B2 12/2002 Everaars et al.
2001/0031416 A1 10/2001 Everaars et al.

FOREIGN PATENT DOCUMENTS

JP 2001290303 A 10/2001

*Primary Examiner* — Mark A Chapman
(74) *Attorney, Agent, or Firm* — Studebaker & Brackett PC

(57) ABSTRACT

A toner includes toner particles. The toner particles each include a toner core and a shell layer covering a surface of the toner core. The toner core contains composite particles. The composite particles are particles of a composite of a releasing agent, an electrically conductive polymer, and a dopant. A ratio of an amount of the composite particles to a mass of the toner cores is at least 0.5% by mass and no greater than 15.0% by mass.

6 Claims, 5 Drawing Sheets

TONER, IMAGE FORMING APPARATUS, AND IMAGE FORMING METHOD

INCORPORATION BY REFERENCE

The present application claims priority under 35 U.S.C. § 119 to Japanese Patent Application No. 2018-019061, filed on Feb. 6, 2018. The contents of this application are incorporated herein by reference in their entirety.

BACKGROUND

The present disclosure relates to a toner, an image forming apparatus, and an image forming method.

A known example of toner particles included in a toner each include a core provided with an electrically conductive surface layer.

SUMMARY

A toner according to one aspect of the present disclosure includes toner particles. The toner particles each include a toner core and a shell layer covering a surface of the toner core. The toner core contains composite particles. The composite particles are particles of a composite of a releasing agent, an electrically conductive polymer, and a dopant. A ratio of an amount of the composite particles to a mass of the toner cores is at least 0.5% by mass and no greater than 15.0% by mass.

An image forming apparatus according to another aspect of the present disclosure includes a toner accommodation section, an image bearing member, a development section, a transfer section, and a fixing section. The toner accommodation section accommodates a toner. The development section develops an electrostatic latent image on the image bearing member into a toner image with the toner supplied from the toner accommodation section. The transfer section transfers the toner image on the image bearing member onto a recording medium. The fixing section fixes to the recording medium the toner image transferred to the recording medium. The toner is the toner according to the above-described one aspect of the present disclosure.

An image forming method according to still another aspect of the present disclosure includes developing, transferring, and fixing. In the developing, a development section develops an electrostatic latent image on an image bearing member into a toner image with a toner supplied from a toner accommodation section. In the transferring, a transfer section transfers the toner image on the image bearing member onto a recording medium. In the fixing, a fixing section fixes to the recording medium the toner image transferred to the recording medium. The toner is the toner according to the above-described one aspect of the present disclosure. In the fixing, the shell layers of the toner particles of the toner forming the toner image are fractured by the fixing section to cause attachment of the composite particles contained in the toner cores to a surface of the fixing section.

DETAILED DESCRIPTION

Evaluation results (values indicating shape, physical properties, or the like) for a powder (specific examples include toner cores, toner particles, an external additive, and a toner) are each a number average of values measured for an appropriate number of particles of the powder, unless otherwise stated. A number average particle diameter of a powder is a number average value of equivalent circle diameters of primary particles of the powder measured using a microscope, unless otherwise stated. The term "equivalent circle diameter" refers to a Heywood diameter that indicates a diameter of a circle having the same area as a projected area of a particle. A measured value for a volume median diameter (Dso) of a powder is a value measured based on the Coulter principle (electrical sensing zone method) using "COULTER COUNTER MULTISIZER 4" manufactured by Beckman Coulter, Inc., unless otherwise stated. In the following description, "glass transition point" may be referred to as "Tg" and "softening point" may be referred to as "Tm".

Strength of chargeability referred to herein indicates easiness of chargeability through friction with a standard carrier provided by The Imaging Society of Japan, unless otherwise stated. A measurement target (for example, a toner) is triboelectrically charged through mixing and stirring with a standard carrier (N-01 for anionic measurement target, P-01 for cationic measurement target) provided by The Imaging Society of Japan. A surface potential of the measurement target is measured before and after triboelectric charging using a kelvin probe force microscope (KFM), for example. A measurement target having a greater difference in electric potential between before and after triboelectric charging has stronger chargeability.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. Also, the term "(meth)acryl" may be used as a generic term encompassing both acryl and methacryl.

[Toner]

The following describes an embodiment of the present disclosure. The present embodiment relates to a toner. The toner includes toner particles. The toner is a collection (powder) of the toner particles.

Figure 1:
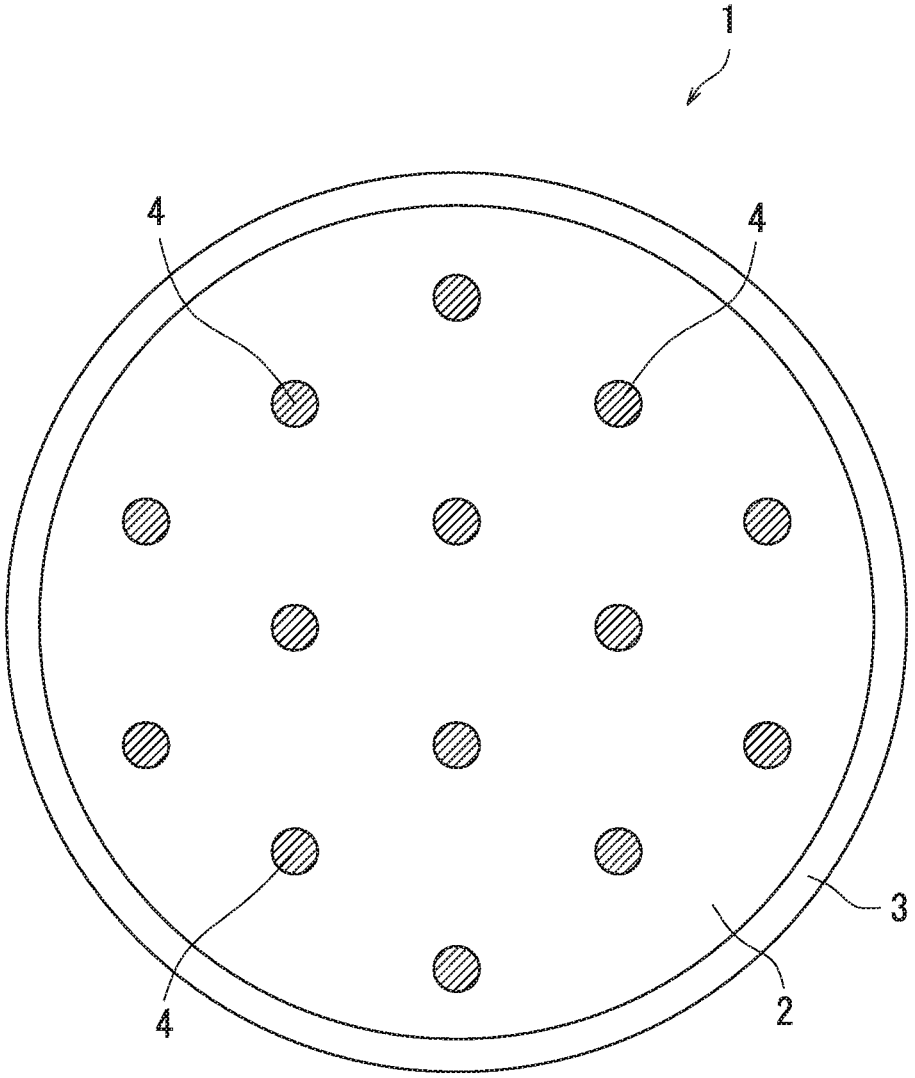
FIG. 1 is a diagram illustrating an example of a sectional structure of a toner particle included in a toner according to an embodiment of the present disclosure.

FIG. 1 is a diagram illustrating an example of a sectional structure of a toner particle 1 included in a toner T (see FIG. 4) according to the present embodiment. The toner particle 1 illustrated in FIG. 1 includes a toner core 2 and a shell layer 3. The shell layer 3 covers a surface of the toner core 2. The toner core 2 contains composite particles 4. The composite particles 4 are particles of a composite of a releasing agent, an electrically conductive polymer, and a dopant.

Through use of the toner T according to the present embodiment, occurrence of offset due to attachment of the toner T to a fixing section 30 (see FIG. 2) can be inhibited.

Reasons therefore are considered as follows. However, the following reasons are hypotheses and should not be taken to limit the present disclosure.

First, the following describes a case where the toner T according to the present embodiment is a positively chargeable toner. A surface of the fixing section 30 included in an image forming apparatus 100 (see FIG. 4) has a tendency to be negatively charged. The tendency to be negatively charged is remarkable in a configuration in which the surface of the fixing section 30 is constituted by a fluororesin layer. This is because a fluororesin has strong negative chargeability. When a recording medium P passes the fixing section 30 in image formation, the recording medium P tends to be positively charged through friction with the fixing section 30. A positively chargeable toner tends to be electrostatically attached more to the fixing section 30 negatively charged through friction than to the recording medium P positively charged through friction. As a result of attachment of the positively chargeable toner to the fixing section 30, offset occurs.

Here, it is noted that the toner cores 2 of the toner T according to the present embodiment contain the composite particles 4. The composite particles 4 are particles of a composite of a releasing agent, an electrically conductive polymer, and a dopant. Upon fixing in image formation, the shell layers 3 of the toner particles 1 on the recording medium P are fractured by the fixing section 30. As a result, the toner cores 2 of the toner particles 1 are exposed on the recording medium P and the composite particles 4 contained in the toner cores 2 move from the recording medium P to the surface of the fixing section 30 to be attached to the surface thereof.

Figure 2:
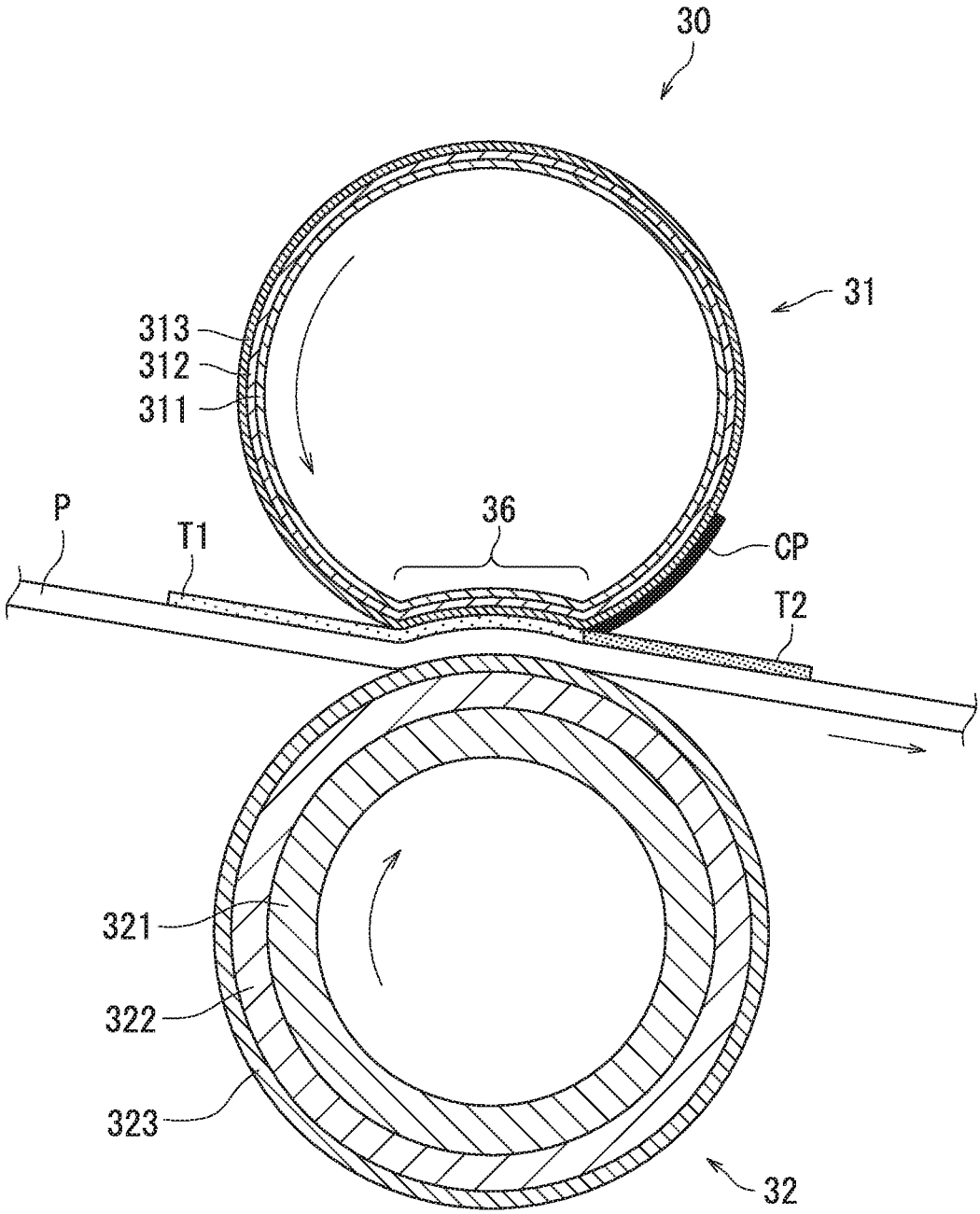
FIG. 2 is a diagram illustrating a fixing belt and a pressure roller included in a fixing section.

The following further describes the reasons why occurrence of offset can be inhibited in more detail with reference to FIG. 2. FIG. 2 illustrates an example of the fixing section 30 included in the image forming apparatus 100. The fixing section 30 includes a fixing belt 31 and a pressure roller 32. The recording medium P passes through a nip part 36 between the fixing belt 31 and the pressure roller 32. A surface of the recording medium P that comes into contact with the fixing belt 31 has an unfixed toner image T1 formed thereon. The unfixed toner image T1 is formed from the toner particles 1. When the recording medium P passes through the nip part 36 between the fixing belt 31 and the pressure roller 32, the shell layers 3 of the toner particles 1 included in the unfixed toner image T1 on the recording medium P are fractured. As a result, the toner cores 2 of the toner particles 1 are exposed on the recording medium P and the composite particles 4 contained in the toner cores 2 move from the recording medium P to be attached to a surface of the fixing belt 31 of the fixing section 30. The attached composite particles 4 form a composite particle layer CP on the surface of the fixing belt 31. When the recording medium P passes through the nip part 36 between the fixing belt 31 and the pressure roller 32, the toner particles 1 including the fractured shell layers 3 are fixed to the recording medium P. As a result, a toner image T2 is formed from the fixed toner particles 1 on the surface of the recording medium P in contact with the fixing belt 31.

Figure 3:
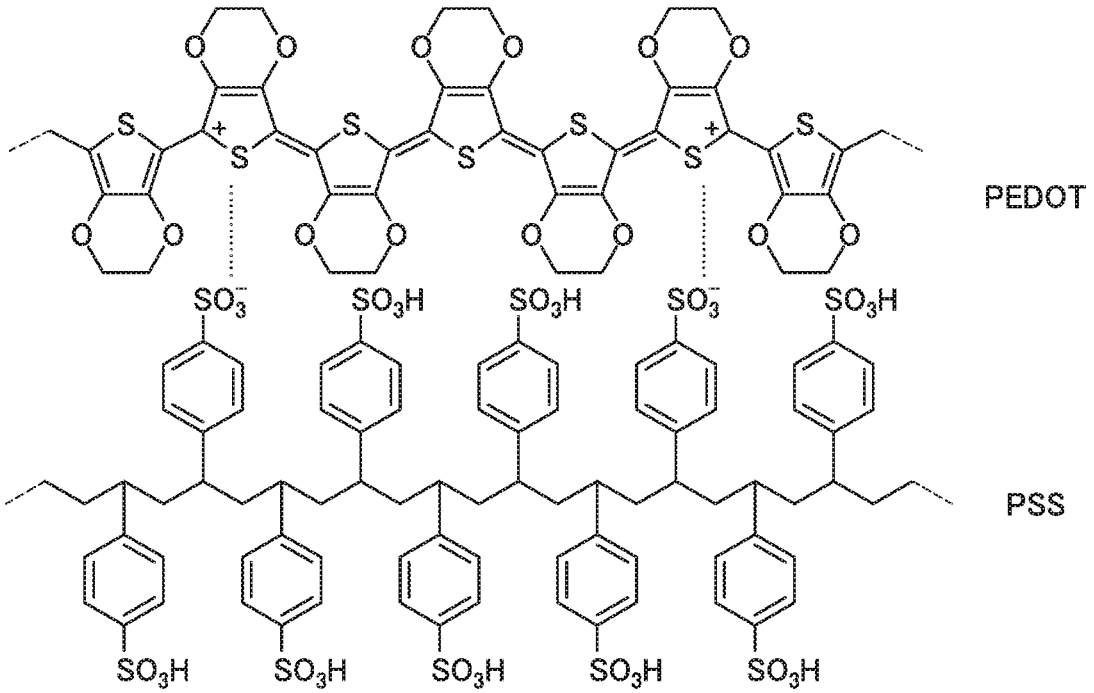
FIG. 3 is a diagram illustrating an example of an electrically conductive polymer and an example of a dopant.

Examples of the electrically conductive polymer contained in the composite particles 4 are roughly classified into electrically conductive polymers that transport holes and electrically conductive polymers that transport electrons. The following describes a case where the electrically conductive polymer transports holes with reference to FIG. 3 in addition to FIG. 2. FIG. 3 illustrates an example of the electrically conductive polymer and an example of the dopant. Examples of the electrically conductive polymer include poly(3,4-ethylenedioxythiophene) (hereinafter represented by PEDOT). PEDOT in FIG. 3 represents poly(3,4-ethylenedioxythiophene) as the example of the electrically conductive polymer. PSS in FIG. 3 represents polystyrene sulfonic acid as the example of the dopant (specifically, an acceptor). When the composite particles 4 are attached to the surface of the fixing belt 31, the dopant (for example, PSS) contained in the composite particles 4 extracts electrons from the electrically conductive polymer (for example, PEDOT). As a result, holes are generated in the electrically conductive polymer (for example, PEDOT) and the holes move. The holes move from the composite particle layer CP to the surface of the fixing belt 31 and neutralize charge of electrons on the surface of the fixing belt 31 negatively charged through friction. For this reason, the fixing belt 31 tends not to be negatively charged through friction and occurrence of offset can be inhibited.

The following describes a case where the electrically conductive polymer transports electrons. When the composite particles 4 are attached to the surface of the fixing belt 31, the dopant (specifically, a donor) contained in the composite particles 4 gives electrons to the electrically conductive polymer. The given electrons move within the electrically conductive polymer. As a result, electrons on the surface of the fixing belt 31 negatively charged through friction are expelled by the electrons flowing within the electrically conductive polymer contained in the composite particle layer CP attached to the surface of the fixing belt 31. For this reason, the fixing belt 31 tends not to be negatively charged through friction and occurrence of offset can be inhibited.

According to the present embodiment, the composite particles 4 are continuously supplied to the surface of the fixing belt 31 from the toner T used for image formation. Therefore, occurrence of offset can be inhibited even in successive image formation and in image formation on a large number of sheets. Through the above, the reasons why occurrence of offset due to attachment of the toner to the fixing section 30 can be inhibited have been described with reference to FIGS. 2 and 3.

It is thought that image flows in formed images can be reduced in a case where the toner T according to the present embodiment is a negatively chargeable toner. A negatively chargeable toner electrostatically repels the fixing section 30 negatively charged through friction. Electrostatic repellence against the fixing section 30 may cause slight displacement of the negatively chargeable toner on the recording medium P. The displacement causes an image flow in a formed image. Here, it is noted that through use of the toner T according to the present embodiment, the fixing section 30 tends not to be negatively charged through friction as described above. Accordingly, in a case where the toner T according to the present embodiment is a negatively chargeable toner, image flows in formed images can be reduced.

The following continues description of the structure of the toner particles 1 included in the toner T with reference to FIG. 1 again. Since the surfaces of the toner cores 2 are covered with the shell layers 3, the toner T tends not to lose electric charge. Therefore, an amount of charge of the toner T can be kept within a desired range. As a result, occurrence of an image defect such as toner scattering can be inhibited. The shell layers 3 each preferably substantially cover an entire surface region of a corresponding toner core 2, and more preferably completely cover the entire surface region of the toner core 2.

The composite particles 4 are located within the toner core 2. Since the composite particles 4 are located within the toner core 2, the toner T tends not to lose electric charge. Therefore, an amount of charge of the toner T can be kept within the desired range. As a result, occurrence of an image defect such as toner scattering can be inhibited while offset due to attachment of the toner to the fixing section 30 is inhibited. Preferably, no composite particle 4 is located outside the toner core 2. Preferably, no composite particle 4 is located on the surface of the toner core 2. Preferably, no composite particle 4 is located between the toner core 2 and the shell layer 3 (i.e., at an interface therebetween). Preferably, no composite particle 4 is located within the shell layer 3. Preferably, no composite particle 4 is located on a surface of the shell layer 3. Preferably, no composite particle 4 is located in an outermost surface of the toner particle 1. Through the above, the structure of the toner particles 1 included in the toner T has been described with reference to FIG. 1. The following further describes the toner.

<Toner Cores>

The toner cores contain the composite particles. The toner cores may further contain at least one of a binder resin, a colorant, a releasing agent, a charge control agent, and a magnetic powder, as necessary.

(Composite Particles)

The composite particles are particles of a composite of a releasing agent, an electrically conductive polymer, and a dopant. A ratio of the amount of the composite particles to the mass of the toner cores is at least 0.5% by mass and no greater than 15.0% by mass. A ratio of the amount of the composite particles to the mass of the toner cores of at least 0.5% by mass enables inhibition of occurrence of offset since the fixing belt tends not to be negatively charged through friction owing to the presence of the composite particles attached to the surface of the fixing belt. A ratio of the amount of the composite particles to the mass of the toner cores of no greater than 15.0% by mass enables favorable fixing of the toner to the recording medium.

In order to improve low-temperature fixability of the toner while inhibiting occurrence of offset and occurrence of an image defect such as toner scattering, the ratio of the amount of the composite particles to the mass of the toner cores is preferably at least 0.5% by mass and no greater than 10.0% by mass.

In order to particularly inhibit occurrence of offset, the ratio of the amount of the composite particles to the mass of the toner cores is preferably at least 11.0% by mass and no greater than 15.0% by mass.

The ratio of the amount of the composite particles to the mass of the toner cores may be within any of the following ranges: at least 0.5% by mass and smaller than 3.0% by mass; at least 3.0% by mass and smaller than 5.0% by mass; at least 5.0% by mass and smaller than 10.0% by mass; and at least 10.0% by mass and no greater than 15.0% by mass.

A ratio of the amount of the electrically conductive polymer to the amount of the toner cores is preferably at least 0.1% by mass and no greater than 10.0% by mass. A ratio of the amount of the electrically conductive polymer to the amount of the toner cores of at least 0.1% by mass enables inhibition of occurrence of offset since the fixing belt tends not to be negatively charged through friction owing to the presence of the electrically conductive polymer attached to the surface of the fixing belt. A ratio of the amount of the electrically conductive polymer to the amount of the toner cores of no greater than 10.0% by mass enables favorable fixing of the toner to the recording medium.

In order to improve low-temperature fixability of the toner while inhibiting occurrence of offset and occurrence of an image defect such as toner scattering, the ratio of the amount of the electrically conductive polymer to the amount of the toner cores is preferably at least 0.1% by mass and no greater than 5.0% by mass.

In order to particularly inhibit occurrence of offset, the ratio of the amount of the electrically conductive polymer to the amount of the toner cores is preferably at least 6.0% by mass and no greater than 10.0% by mass.

The ratio of the amount of the electrically conductive polymer to the amount of the toner cores may be within any of the following ranges: at least 0.1% by mass and smaller than 1.0% by mass; at least 1.0% by mass and smaller than 3.0% by mass; at least 3.0% by mass and smaller than 4.0% by mass; at least 4.0% by mass and smaller than 5.0% by mass; at least 5.0% by mass and smaller than 7.0% by mass; and at least 7.0% by mass and no greater than 10.0% by mass.

In order to inhibit occurrence of an image defect such as toner scattering while inhibiting occurrence of offset due to attachment of the toner to the fixing section, a ratio of the amount of the electrically conductive polymer to the amount of the composite particles is preferably at least 50.0% by mass and no greater than 70.0% by mass. The ratio of the amount of the electrically conductive polymer to the amount of the composite particles may be within any of the following ranges: at least 50.0% by mass and smaller than 52.0% by mass; at least 52.0% by mass and smaller than 54.0% by mass; at least 54.0% by mass and smaller than 60.0% by mass; and at least 60.0% by mass and no greater than 70.0% by mass.

In order to inhibit occurrence of an image defect such as toner scattering while inhibiting occurrence of offset due to attachment of the toner to the fixing section, a ratio of the amount of the dopant to the amount of the electrically conductive polymer is preferably at least 5% by mass and no greater than 20% by mass. The ratio of the amount of the dopant to the amount of the electrically conductive polymer may be within any of the following ranges: at least 5% by mass and smaller than 10% by mass; at least 10% by mass and smaller than 15% by mass, and at least 15% by mass and no greater than 20% by mass.

The composite particles contain a releasing agent. In the following description, the "releasing agent contained in the composite particles" may be referred to as a "first releasing agent". Examples of the first releasing agent include aliphatic hydrocarbon waxes (specific examples include low molecular weight polyethylene, low molecular weight polypropylene, polyolefin copolymer, polyolefin wax, microcrystalline wax, paraffin wax, and Fischer-Tropsch wax), oxides of aliphatic hydrocarbon waxes (specific examples include polyethylene oxide wax and block copolymer thereof), plant waxes (specific examples include candelilla wax, carnauba wax. Japan wax, jojoba wax, and rice wax), animal waxes (specific examples include beeswax, lanolin, and spermaceti), mineral waxes (specific examples include ozokerite, ceresin, and petrolatum), waxes containing a fatty acid ester as a main component (specific examples include montanic acid ester wax and castor wax), and waxes in which a fatty acid ester is partially or completely deoxidized (specific examples include deoxidized carnauba wax). A carnauba wax is preferable as the first releasing agent. The composite particles may contain only one first releasing agent, or two or more first releasing agents.

Electrically conductive polymers have a $\pi$-conjugated system. Electrically conductive polymers are roughly classified into electrically conductive polymers that transport holes and electrically conductive polymers that transport electrons. Specific examples of electrically conductive polymers include polythiophene, derivatives of polythiophene, polyaniline, derivatives of polyaniline, polypyrrole, derivatives of polypyrrole, polyacetylene, and derivatives of polyacetylene. Examples of preferable electrically conductive polymers include polythiophene, derivatives of polythiophene, polyaniline, and derivatives of polyaniline. In terms of favorable color development of the toner, a transparent electrically conductive polymer is preferable.

Examples of polythiophene and derivatives thereof include polythiophene, poly(3-methylthiophene), poly(3-ethylthiophene), poly(3-propylthiophene), poly(3-butylthiophene), poly(3-hexylthiophene), poly(3-heptylthiophene), poly(3-octylthiophene), poly(3-decylthiophene), poly(3-dodecylthiophene), poly(3-octadecylthiophene), poly(3-bromothiophene), poly(3-chlorothiophene), poly(3-iodothiophene), poly(3-cyanothiophene), poly(3-phenylthiophene), poly(3,4-dimethylthiophene), poly(3,4-dibutylthiophene), poly(3-hydroxythiophene), poly(3-methoxythiophene), poly(3-ethoxythiophene), poly(3-butoxythiophene), poly(3-hexyloxythiophene), poly(3-heptyloxythiophene), poly(3-octyloxythiophene), poly(3-decyloxythiophene), poly(3-dodecyloxythiophene), poly(3-octadecyloxythiophene), poly(3,4-dihydroxythiophene), poly(3,4-dimethoxythiophene), poly(3,4-diethoxythiophene), poly(3,4-dipropoxythiophene), poly(3,4-dibutoxythiophene), poly(3,4-dihexyloxythiophene), poly(3,4-diheptyloxythiophene), poly(3,4-dioctyloxythiophene), poly(3,4-didecyloxythiophene), poly(3,4-didodecyloxythiophene), poly(3,4-ethylenedioxythiophene), poly(3,4-propylenedioxythiophene), poly(3,4-butenedioxythiophene), poly(3-methyl-4-methoxythiophene), poly(3-methyl-4-ethoxythiophene), poly(3-carboxythiophene), poly(3-methyl-4-carboxythiophene), poly(3-methyl-4-carboxyethylthiophene), poly(3-methyl-4-carboxybutylthiophene), and poly(3,4-ethylenedioxythiophene). Preferable derivatives of polythiophene are: a polymer of thiophene substituted with at least one chemical group selected from the group consisting of an alkyl group having a carbon number of at least 1 and no greater than 20, a halogen atom, a cyano group, a phenyl group, a hydroxy group, and an alkoxy group having a carbon number of at least 1 and no greater than 20; and a polymer of alkylenedioxythiophene having a carbon number of at least 5 and no greater than 10. Among polythiophene and the derivatives thereof listed above, polythiophene or a polymer of alkylenedioxythiophene having a carbon number of at least 5 and no greater than 10 is preferable, and poly(3,4-ethylenedioxythiophene) is more preferable.

Examples of polyaniline and derivatives thereof include polyaniline, poly(2-methylaniline), and poly(2-ethylaniline). A preferable derivative of polyaniline is a polymer of aniline substituted with an alkyl group having a carbon number of at least 1 and no greater than 6. Among polyaniline and the derivatives thereof listed above, a polymer of aniline substituted with an alkyl group having a carbon number of at least 1 and no greater than 6 or polyaniline is preferable.

Dopants are roughly classified into acceptors and donors. An acceptor accepts electrons. In a case where the electrically conductive polymer transports holes, the dopant serves as an acceptor. A donor emits electrons. In a case where the electrically conductive polymer transports electrons, the dopant serves as a donor.

Examples of dopants include polyanions. A polyanion is a polymer of a constitutional unit having an anionic group. Examples of polyanions include polystyrene sulfonic acid, polyvinyl sulfonic acid, polyallyl sulfonic acid, polyacryl sulfonic acid, polymethacryl sulfonic acid, poly(2-acrylamide-2-methylpropanesulfonic acid), polyisoprene sulfonic acid, polysulfoethyl methacrylate, poly(4-sulfobutyl methacrylate), polymethacryloxybenzene sulfonic acid, polyvinyl carboxylic acid, polystyrene carboxylic acid, polyallyl carboxylic acid, polyacryl carboxylic acid, polymethacryl carboxylic acid, poly(2-acrylamide-2-methylpropanecarboxylic acid), polyisoprene carboxylic acid, polyacrylic acid, and polysulfonated phenylacetylene. The dopant may be a homopolymer, which is any of the above-listed polymers. Alternatively, the dopant may be a copolymer of two or more of the above-listed polymers. Polystyrene sulfonic acid is preferable as the dopant.

The composite particles may further contain a curing agent. Examples of curing agents include amine curing agents. Examples of amine curing agents include imidazole, 2-ethyl-4-methylimidazole, diaminodiphenylmethane, diethylenetriamine, triethylenetetramine, diaminodiphenylsulfone, and isophoronediamine. Imidazole is preferable as the curing agent.

The following method can confirm that the composite particles contain the electrically conductive polymer and the dopant, for example. The toner is dispersed in a cold-setting epoxy resin and the epoxy resin is left to stand in an atmosphere at 40° C. for two days to obtain a hardened material. The hardened material is sliced using a microtome ("EM UC6" manufactured by Leica Microsystems K.K.) to obtain a thin sample piece having a thickness of 200 nm for observation of toner particle cross section. The thin sample piece is observed using a transmission electron microscope (TEM, "JSM-6700F" manufactured by JEOL Ltd.) at a magnification of 3,000× or 10.000×, and a TEM photograph of cross sections of toner particles is captured. Mapping of characteristic elements of the electrically conductive polymer (for example, sulfur and nitrogen) in the TEM photograph is performed by electron energy loss spectroscopy (EELS). Through the above, it can be confirmed that the composite particles contain the electrically conductive polymer. Also, mapping of characteristic elements of the dopant (for example, sulfur) is performed in the TEM photograph by electron energy loss spectroscopy (EELS). Through the above, it can be confirmed that the composite particles contain the dopant. Note that the hardened material may be dyed with osmium tetroxide and then observed using the TEM. The releasing agent contained in the composite particles is hardly dyed, while the electrically conductive polymer and the dopant contained in the composite particles are readily dyed. Therefore, the releasing agent can be distinguished from the electrically conductive polymer and the dopant in observation.

Preferably, a component of the toner cores other than the composite particles contains no electrically conductive polymer and no dopant. For example, a binder resin, a colorant, a charge control agent, and a magnetic powder preferably contain no electrically conductive polymer and no dopant. Also, a releasing agent (hereinafter may be referred to as a second releasing agent) that is contained in the toner cores and that is not contained in the composite particles preferably contains no electrically conductive polymer and no dopant.

(Binder Resin)

A thermoplastic resin is preferable as the binder resin. Examples of thermoplastic resins include polyester resins, styrene-based resins, acrylic acid-based resins, olefin-based resins, vinyl resins, polyamide resins, and urethane resins. A copolymer of any of these resins, that is, a copolymer formed through introduction of a repeating unit into any of these resins can also be used as a thermoplastic resin that constitutes the binder resin. For example, a styrene-acrylic acid-based resin or a styrene-butadiene-based resin can also be used as a thermoplastic resin that constitutes the binder resin. The toner cores may contain only a single binder resin, or two or more (for example, two or three) binder resins. A polyester resin is preferable as the binder resin.

A polyester resin is obtained through condensation polymerization or co-condensation polymerization of an alcohol monomer and a carboxylic acid monomer.

The polyester resin is a polymer of the alcohol monomer and the carboxylic acid monomer.

Examples of alcohol monomers include diol monomers, bisphenol monomers, and tri- or higher-hydric alcohol monomers.

Examples of diol monomers include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol.

Examples of bisphenol monomers include bisphenol A, hydrogenated bisphenol A, bisphenol A ethylene oxide adduct, and bisphenol A propylene oxide adduct (for example, bisphenol A-propylene oxide 2 mole adduct).

Examples of tri- or higher-hydric alcohol monomers include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of carboxylic acid monomers include dibasic carboxylic acid monomers and tri- or higher-basic carboxylic acid monomers.

Examples of dibasic carboxylic acid monomers include maleic acid, fumaric acid, citraconic acid, itaconic acid, glutaconic acid, phthalic acid, isophthalic acid, terephthalic acid, 5-sulfoisophthalic acid, sodium 5-sulfoisophthalate, cyclohexanedicarboxylic acid, adipic acid, sebacic acid, azelaic acid, malonic acid, succinic acid, alkyl succinic acids, and alkenyl succinic acids. Examples of alkyl succinic acids include n-butylsuccinic acid, isobutylsuccinic acid, n-octylsuccinic acid, n-dodecylsuccinic acid, and isododecylsuccinic acid. Examples of alkenyl succinic acids include n-butenylsuccinic acid isobutenylsuccinic acid, n-octenylsuccinic acid, n-dodecenylsuccinic acid, and isododecenylsuccinic acid.

Examples of tri- or higher-basic carboxylic acid monomers include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Only one alcohol monomer may be used independently, or two or more alcohol monomers may be used. Only one carboxylic acid monomer may be used independently, or two or more carboxylic acid monomers may be used. Further, a carboxylic acid monomer may be derivatized to be used as an ester-forming derivative. Examples of ester-forming derivatives include acid halides, acid anhydrides, and alkyl esters (for example, alkyl esters having an alkyl group having a carbon number of at least 1 and no greater than 6). In order that the toner can be suitable for use in image formation, the amount of the binder resin is preferably at least 50% by mass and no greater than 99% by mass relative to the mass of the toner cores.

Preferably, the binder resin has a glass transition point (Tg) of at least 30° C. and no higher than 80° C. The glass transition point of the binder resin may be within any of the following ranges: at least 30° C. and lower than 40° C.; at least 40° C. and lower than 60° C.; and at least 60° C. and no higher than 80° C. Preferably, the binder resin has a softening point (Tm) of at least 60° C. and no higher than 130° C. The softening point of the binder resin may be within any of the following ranges: at least 60° C. and lower than 80° C.; at least 80° C. and lower than 110° C.; and at least 110° C. and no higher than 130° C.

The glass transition point of the binder resin can be measured by plotting a heat absorption curve of a sample (binder resin) using a differential scanning calorimeter ("DSC-6220" manufactured by Seiko Instruments Inc.). Specifically, 15 mg of the sample is placed on an aluminum pan and the aluminum pan is set in a measurement section of the measurement device. An empty aluminum pan is used as a reference. In plotting the heat absorption curve, the temperature of the measurement section is increased from a measurement start temperature of 10° C. up to 150° C. at a rate of 10° C./minute (RUN 1). Thereafter, the temperature of the measurement section is reduced from 150° C. to 10° C. at a rate of 10° C./minute. Subsequently, the temperature of the measurement section is re-increased from 10° C. up to 150° C. at a rate of 10° C./minute (RUN 2). The heat absorption curve (vertical axis: heat flow (DSC signal), horizontal axis: temperature) is plotted in RUN 2. The glass transition point of the sample is read from the plotted heat absorption curve. In the heat absorption curve, a temperature (onset temperature) at a point of change in specific heat (i.e., an intersection point between an extrapolation line of a base line and an extrapolation line of an inclined portion of the curve) corresponds to the glass transition point of the sample.

The softening point of the binder resin referred to herein is a value measured using a capillary rheometer ("CFT-500D" manufactured by Shimadzu Corporation), unless otherwise stated.

(Colorant)

The toner cores may contain a colorant as necessary. A known pigment or dye that matches the color of the toner can be used as the colorant. In order that the toner can be suitable for use in image formation, the amount of the colorant is preferably at least 1% by mass and no greater than 20% by mass relative to the mass of the toner cores. The toner cores may contain only one colorant or two or more colorants.

The toner cores may contain a black colorant. An example of black colorants is carbon black. Alternatively, a colorant adjusted to black color using a yellow colorant, a magenta colorant, and a cyan colorant may be used as a black colorant.

The toner cores may contain a non-black colorant. Examples of non-black colorants include a yellow colorant, a magenta colorant, and a cyan colorant.

At least one compound selected from the group consisting of condensed azo compounds, isoindolinone compounds, anthraquinone compounds, azo metal complexes, methine compounds, and arylamide compounds can for example be used as a yellow colorant. Examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as a magenta colorant. Examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as a cyan colorant. Examples of cyan colorants include C.I. Pigment Blue (1, 7, 15, 15:1, 15:2, 15:3, 15:4, 60, 62, or 66), Phthalocyanine Blue, C.I. Vat Blue, and C.I. Acid Blue.

(Second Releasing Agent)

The toner cores may further contain the second releasing agent that is not contained in the composite particles, other than the first releasing agent contained in the composite particles. Examples of the second releasing agent are the same as those of the first releasing agent. A carnauba wax is preferable as the second releasing agent. The toner cores may contain only one second releasing agent or two or more second releasing agents.

(Charge Control Agent)

The toner cores may contain a charge control agent. The charge control agent is used for the purpose of obtaining a toner excellent in charge stability and a charge rise characteristic, for example. The charge rise characteristic of the toner is an indicator as to whether or not the toner can be charged to a specific charge level in a short period of time.

Anionic strength of the toner cores can be increased through the toner cores containing a negatively chargeable charge control agent (specific examples include organic metal complexes and chelate compounds). Cationic strength of the toner cores can be increased through the toner cores containing a positively chargeable charge control agent (specific examples include pyridine, nigrosine, and quaternary ammonium salt). However, it is inessential that the toner cores contain a charge control agent so long as the toner has sufficient chargeability.

(Magnetic Powder)

The toner cores may contain a magnetic powder. Examples of materials of the magnetic powder include ferromagnetic metals (specific examples include iron, cobalt, nickel, and alloys thereof), ferromagnetic metal oxides (specific examples include ferrite, magnetite, and chromium dioxide), and materials subjected to ferromagnetization (specific examples include carbon materials rendered ferromagnetic through thermal treatment). The toner cores may contain only one magnetic powder or two or more magnetic powders. In order to inhibit elution of metal ions (for example, iron ions) from the magnetic powder, the magnetic powder is preferably subjected to surface treatment.

<Shell Layers>

The shell layers contain a resin. In the following description, the "resin contained in the shell layers" may be referred to as a "shell resin". The shell layers are preferably formed from the shell resin, and more preferably formed from the shell resin only. A styrene-based resin or a styrene-acrylic acid-based resin is preferable as the shell resin. A styrene-based resin is a polymer of one or more monomers including a styrene-based monomer. A styrene-acrylic acid-based resin is a polymer of monomers including a styrene-based monomer and an acrylic acid-based monomer.

A styrene-based monomer is styrene or a derivative thereof. Examples of styrene-based monomers include styrene, alkyl styrenes (specific examples include α-methylstyrene, p-ethylstyrene, and 4-tert-butylstyrene), and halogenated styrenes (specific examples include α-chlorostyrene, o-chlorostyrene, m-chlorostyrene, and p-chlorostyrene). Styrene is preferable as the styrene-based monomer.

An acrylic acid-based monomer is (meth)acrylic acid or a derivative thereof. Examples of acrylic acid-based monomers include (meth)acrylic acid, (meth)acrylamide, (meth) acrylonitrile, (meth)acrylic acid alkyl esters, and (meth) acrylic acid hydroxyalkyl esters. Examples of (meth)acrylic acid alkyl esters include methyl (meth)acrylate, ethyl (meth) acrylate, propyl (meth)acrylates (specific examples include n-propyl (meth)acrylate and iso-propyl (meth)acrylate), butyl (meth)acrylates (specific examples include n-butyl (meth)acrylate and iso-butyl (meth)acrylate), and 2-ethylhexyl (meth)acrylate. Examples of (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate. Butyl (meth) acrylate is preferable as the acrylic acid-based monomer, and butyl acrylate is more preferable.

The shell resin preferably has a glass transition point (Tg) of at least 60° C. and no higher than 100° C., and more preferably at least 65° C. and no higher than 75° C. A method for measuring the glass transition point of the shell resin is the same as that for measuring the glass transition point of the binder resin.

<External Additive>

An external additive (specifically, a powder, which is a collection of external additive particles) may be attached to surfaces of the toner particles. Unlike internal additives, the external additive is not present inside the toner particles and is selectively present only on the surfaces of the toner particles (in surface layers of the toner particles). The external additive particles can be attached to the surfaces of the toner particles by stirring the toner particles (powder) and the external additive (powder) together, for example. The toner particles and the external additive particles do not chemically react each other, and are connected to each other physically rather than chemically. Strength of connection between the toner particles and the external additive particles can be adjusted by controlling stirring conditions (specific examples include stirring time and rotational speed for stirring), particle diameter of the external additive particles, shape of the external additive particles, and surface conditions of the external additive particles.

The amount of the external additive (when two or more types of external additive particles are used, a total amount of the respective types of external additive particles) is preferably at least 0.5 parts by mass and no greater than 10 parts by mass relative to 100 parts by mass of the toner particles in order that the external additive can sufficiently exhibit its function while detachment of the external additive particles from the toner particles can be inhibited. The external additive particles preferably have a number average primary particle diameter of at least 5 nm and no greater than 50 nm, and more preferably at least 10 nm and no greater than 35 nm.

Inorganic particles are preferable as the external additive particles, and silica particles or particles of a metal oxide (specific examples include alumina, titanium oxide, magnesium oxide, zinc oxide, strontium titanate, and barium titanate) are particularly preferable. However, particles of an organic acid compound such as a fatty acid metal salt (specific examples include zinc stearate) or resin particles may be used as the external additive particles. The external additive particles may be external additive particles subjected to surface treatment, more specifically, external additive particles rendered positively chargeable (for example, positively chargeable silica particles) through surface treatment. Only one type of external additive particles may be attached to the surfaces of the toner particles, or two or more types of external additive particles may be attached thereto. The toner cores preferably have a volume median diameter ($D_{50}$) of at least 4 μm and no greater than 9 μm. The toner particles preferably have a volume median diameter ($D_{05}$) of at least 4 μm and no greater than 9 μm.

The toner according to the present embodiment can be used for example as a positively chargeable toner or a negatively chargeable toner in development of electrostatic latent images. The toner may be used as a one-component developer. Alternatively, the toner may be mixed with a carrier to be used in a two-component developer. In order to form high-quality images, the amount of the toner in the two-component developer is preferably at least 5 parts by mass and no greater than 15 parts by mass relative to 100 parts by mass of the carrier. The carrier preferably has a number average primary particle diameter of at least 20 pim and no greater than 120 μm. In a case where the toner is used as a one-component developer, the toner is charged positively or negatively through friction with a development sleeve or a toner charging member in a development section. An example of the toner charging member is a doctor blade. In a case where the toner is used in a two-component developer including the toner and a carrier, the toner is charged positively or negatively through friction with the carrier in a development section.

<Toner Production Method>

First, composite particles are prepared. Specifically, a dopant, a first releasing agent, and one or more monomers for synthesizing an electrically conductive polymer are mixed in a solvent. Through the above, the composite particles are obtained. The composite particles may be pulverized using a pulverizer to obtain composite particles having a desired particle diameter.

Examples of monomers for synthesizing the electrically conductive polymer include thiophene, derivatives of thiophene, aniline, derivatives of aniline, pyrrole, derivatives of pyrrole, acetylene, and derivatives of acetylene. Examples of preferable monomers for synthesizing the electrically conductive polymer include thiophene, derivatives of thiophene, aniline, and derivatives of aniline.

Examples of thiophene and derivatives thereof include thiophene, 3-methylthiophene, 3-ethylthiophene, 3-propylthiophene, 3-butylthiophene, 3-hexylthiophene, 3-heptylthiophene, 3-octylthiophene, 3-decylthiophene, 3-dodecylthiophene, 3-octadecylthiophene, 3-bromothiophene, 3-chlorothiophene, 3-iodothiophene, 3-cyanothiophene, 3-phenylthiophene, 3,4-dimethylthiophene, 3,4-dibutylthiophene, 3-hydroxythiophene, 3-methoxythiophene, 3-ethoxythiophene, 3-butoxythiophene, 3-hexyloxythiophene, 3-heptyloxythiophene, 3-octyloxythiophene, 3-decyloxythiophene, 3-dodecyloxythiophene, 3-octadecyloxythiophene, 3,4-dihydroxythiophene, 3,4-dimethoxythiophene, 3,4-diethoxythiophene, 3,4-dipropoxythiophene, 3,4-dibutoxythiophene, 3,4-dihexyloxythiophene, 3,4-diheptyloxythiophene, 3,4-dioctyloxythiophene, 3,4-didecyloxythiophene, 3,4-didodecyloxythiophene, 3,4-ethylenedioxythiophene, 3,4-propylenedioxythiophene, 3,4-butenedioxythiophene, 3-methyl-4-methoxythiophene, 3-methyl-4-ethoxythiophene, 3-carboxythiophene, 3-methyl-4-carboxythiophene, 3-methyl-4-carboxyethylthiophene, 3-methyl-4-carboxybutylthiophene, and 3,4-ethylenedioxythiophene. Preferable derivatives of thiophene are: thiophene substituted with at least one chemical group selected from the group consisting of an alkyl group having a carbon number of at least 1 and no greater than 20, a halogen atom, a cyano group, a phenyl group, a hydroxy group, and an alkoxy group having a carbon number of at least 1 and no greater than 20; and alkylenedioxythiophene having a carbon number of at least 5 and no greater than 10. Among thiophene and the derivatives thereof listed above, thiophene or alkylenedioxythiophene having a carbon number of at least number of 5 and no greater than 10 is preferable, and 3,4-ethylenedioxythiophene is more preferable.

Examples of aniline and derivatives thereof include aniline, 2-methylaniline, and 2-ethylaniline. A preferable derivative of aniline is aniline substituted with an alkyl group having a carbon number of at least 1 and no greater than 6. Among aniline and the derivatives thereof listed above, aniline or aniline substituted with an alkyl group having a carbon number of at least 1 and no greater than 6 is preferable, and aniline is more preferable.

An alcohol is preferable as the solvent, and butanol is more preferable. The curing agent described above may be further added to the solvent. Also, a catalyst may be further added to the solvent. An example of the catalyst is p-toluenesulfonic acid iron(III).

Next, toner cores are prepared. Examples of preferable methods for preparing the toner cores include a pulverization method and an aggregation method. Internal additives can be favorably dispersed in a binder resin through these methods. In general, toner cores are roughly classified into pulverized toner cores and polymerized toner cores (also called chemical toner cores). Toner cores obtained by the pulverization method belong to the pulverized toner cores, and toner cores obtained by the aggregation method belong to the polymerized toner cores. The toner cores of the toner according to the present embodiment are preferably pulverized toner cores.

In an example of the pulverization method, the composite particles and a toner component other than the composite particles are initially mixed to obtain a mixture. The toner component other than the composite particles is for example at least one of a binder resin, a colorant, a charge control agent, a second releasing agent, and a magnetic powder. Subsequently, the resultant mixture is kneaded while being melted using a melt-kneader (for example, a single-screw extruder or a twin-screw extruder) to obtain a kneaded product. The kneaded product is then pulverized and classified. Through the above, toner cores having a desired particle diameter are obtained.

In an example of the aggregation method, the composite particles and particles of a toner component other than the composite particles are initially caused to aggregate in an aqueous medium. The particles of the toner component other than the composite particles are for example particles of at least one of a binder resin, a colorant, a charge control agent, a second releasing agent, and a magnetic powder. Through the above, aggregated particles containing the composite particles and the toner component other than the composite particles are obtained. The obtained aggregated particles are then heated to coalesce components contained in the aggregated particles. Through the above, toner cores having a desired particle diameter are obtained.

Next, shell layers are formed. Examples of shell layer formation methods include in-situ polymerization, in-liquid curing film coating, and coacervation. In an example of shell layer formation methods, the toner cores are added to an aqueous medium in which a material for shell layer formation (hereinafter may be referred to as a "shell material") has been dissolved. The shell material is water-soluble, for example. The aqueous medium is then heated to cause polymerization of the shell material to proceed. Through the above, the shell layers are formed on surfaces of the toner cores.

In formation of the shell layers, resin particles (for example, a resin dispersion) may be used as the shell material. More specifically, the resin particles are attached to the surfaces of the toner cores in a liquid (for example, an aqueous medium) containing the resin particles and the toner cores. The liquid is then heated to cause film formation from the resin particles to proceed. Through the above, the shell layers are formed on the surfaces of the toner cores. Connection of the resin particles to one another (and a consequent cross-linking reaction in the resin particles) can be caused to proceed on the surfaces of the toner cores while the liquid is kept at a high temperature.

The aqueous medium is a medium containing water as a main component (specific examples include pure water and a liquid mixture of water and a polar medium). Examples of polar mediums that can be used in the aqueous medium include alcohols (specific examples include methanol and ethanol).

Next, external additive addition may be performed. In the external additive addition, an external additive can be attached to surfaces of the toner particles by mixing the external additive and the toner particles together using a mixer under such a condition that the external additive is not embedded in the toner particles.

[Image Forming Method and Image Forming Apparatus]

Figure 4:
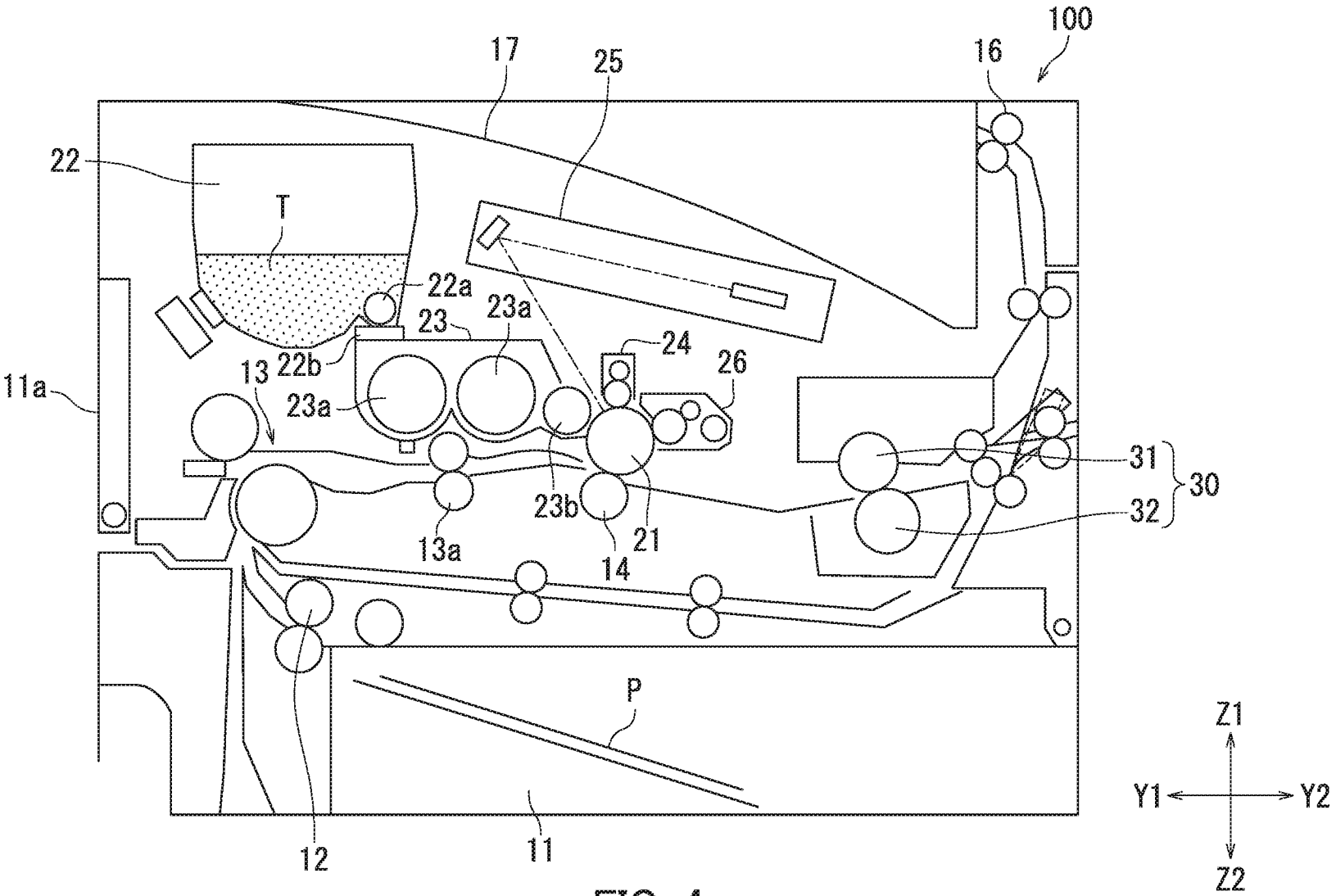
FIG. 4 is a diagram illustrating an example of an image forming apparatus accommodating the toner according to the embodiment of the present disclosure.
Figure 5:
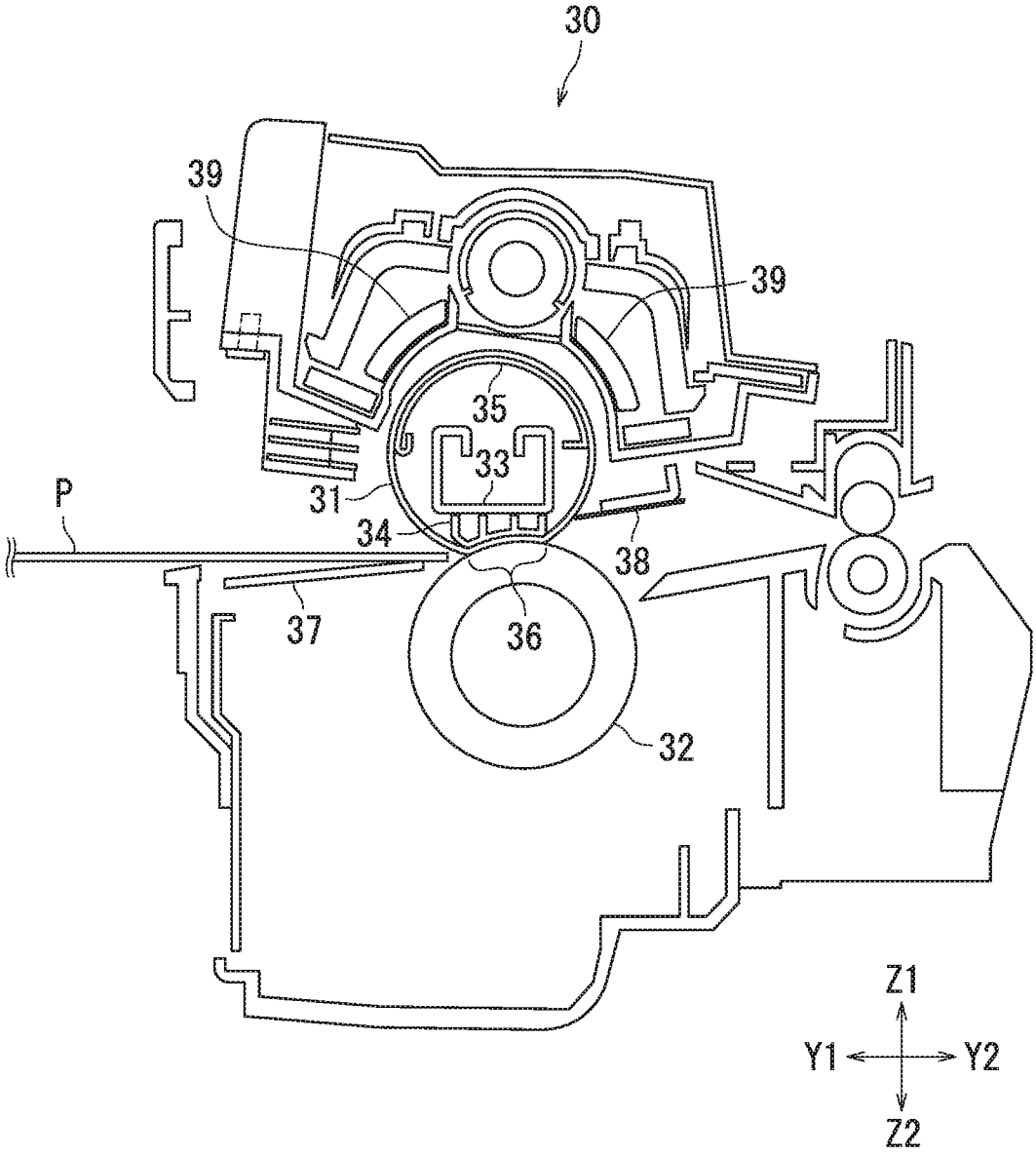
FIG. 5 is a diagram illustrating an example of a fixing section illustrated in FIG. 4.

The following describes an image forming apparatus 100 accommodating the toner T according to the present embodiment and an image forming method using the toner T according to the present embodiment with reference to FIG. 4. In FIG. 4 and FIG. 5 described later, arrows Y1, Y2, Z1, and Z2 indicate four directions along mutually orthogonal two axes (Y and Z axes). The arrow Z1 indicates an upper side of the image forming apparatus 100, and the arrow Z2 indicates a lower side of the image forming apparatus 100. The arrow Y1 indicates a front side of the image forming apparatus 100, and the arrow Y2 indicates a rear side of the image forming apparatus 100.

The image forming apparatus 100 includes a toner accommodation section 22, an image bearing member 21, a development section 23, a transfer section 14, and a fixing section 30. The toner accommodation section 22 accommodates the toner T according to the present embodiment. The development section 23 develops an electrostatic latent image on the image bearing member 21 into a toner image with the toner T supplied from the toner accommodation section 22 (development step). The transfer section 14 transfers the toner image on the image bearing member 21 to a recording medium P (transfer step). The fixing section 30 fixes the toner image transferred to the recording medium P on the recording medium P (fixing step).

The image forming apparatus 100 further includes a sheet feed cassette 11, a manual feed tray 11*a*, a sheet feed roller 12, a conveyance path 13, a conveyance roller 13*a*, an ejection roller 16, an ejection section 17, a charger 24, a light exposure section 25, and a cleaner 26, in addition to the toner accommodation section 22, the image bearing member 21, the development section 23, the transfer section 14, and the fixing section 30. The conveyance roller 13*a* is disposed in the conveyance path 13.

The sheet feed cassette 11 accommodates plural sheets of the recording medium P (for example, printing paper). The sheet feed roller 12 feeds the recording medium P sheet by sheet from the sheet feed cassette 11 to the conveyance path 13. The conveyance roller 13*a* conveys the recording medium P fed to the conveyance path 13 toward the transfer section 14. Note that the recording medium P set on the manual feed tray 11*a* is also conveyed to the transfer section 14 in the same manner as that for the recording medium P accommodated in the sheet feed cassette 11.

The image bearing member 21 is rotatably supported by a housing of the image forming apparatus 100. The image bearing member 21 is driven for example by a motor (not illustrated) to rotate.

The image forming apparatus 100 includes the development section 23 in one-to-one correspondence with the image bearing member 21. Also, the image forming apparatus 100 includes the toner accommodation section 22 in one-to-one correspondence with the development section 23.

The toner accommodation section 22 includes a supply roller 22*a* and a toner replenishment path 22*b*. Upon rotation of the supply roller 22*a*, the toner T accommodated in the toner accommodation section 22 is supplied to the development section 23 through the toner replenishment path 22*b* of the toner accommodation section 22. The supply roller 22*a* is driven for example by a motor (not illustrated) to rotate.

The development section 23 includes a plurality of (for example, two) stirring screws 23*a* and a development roller 23*b*. The development roller 23*b* includes a metal shaft, a magnet roll, and a development sleeve formed from a non-magnetic material. The magnet roll has magnetic poles (for example, an N pole and an S pole derived from a permanent magnet) at least in a surface layer portion thereof, and is secured to the shaft. The development sleeve is disposed on or above the surface layer portion of the magnet roll in a rotatable manner. Specifically, the shaft and the development sleeve are connected by means of a flange in such a manner that the development sleeve is rotatable around the magnet roll that does not rotate.

A two-component developer including the toner T and a carrier (specifically, a magnetic carrier) is accommodated in an accommodation section of the development section 23. The accommodation section of the development section 23 is replenished with the toner T from the toner accommodation section 22 as necessary. Upon rotation of the stirring screws 23*a*, the two-component developer within the accommodation section of the development section 23 is stirred. In a case where the toner T is positively chargeable, the toner T is positively charged through friction with the carrier upon stirring of the two-component developer including the toner T. In a case where the toner T is negatively chargeable, the toner T is negatively charged through friction with the carrier upon stirring of the two-component developer including the toner T. The development roller 23*b* supplies the toner T within the accommodation section of the development section 23 (for example, the toner T supplied from the toner accommodation section 22) to the image bearing member 21. The stirring screws 23*a* and the development roller 23*b* are each driven for example by a motor (not illustrated) to rotate. Note that the developer accommodated in the accommodation section of the development section 23 is not limited to the two-component developer and may be a one-component developer.

The charger 24 for example includes a charging member (specific examples include a charging roller) in contact with a surface of the image bearing member 21. The charger 24 uniformly and electrostatically charges the surface (for example, a photosensitive layer) of the image bearing member 21. Thus, the charger 24 charges the surface (for example, the photosensitive layer) of the image bearing member 21.

The light exposure section 25 for example includes a light-emitting diode (LED) head as a light source. The light exposure section 25 irradiates the surface (for example, the photosensitive layer) of the image bearing member 21 with light to form an electrostatic latent image on the surface of the image bearing member 21.

In image formation on the recording medium P by the image forming apparatus 100, the charger 24 charges the photosensitive layer of the image bearing member 21. Subsequently, the light exposure section 25 selectively irradiates the photosensitive layer of the image bearing member 21 with light. An irradiation position is determined according to image data. The electric potential in a portion of the photosensitive layer irradiated with light decreases. As a result, the electrostatic latent image is formed on the surface of the image bearing member 21.

Subsequently, the development section 23 supplies the charged toner T (for example, the toner T charged through friction with the carrier) to the image bearing member 21 to develop the electrostatic latent image. The charged toner T is selectively attached to the portion of the photosensitive layer in which the electrostatic latent image has been formed. As a result, the toner image is formed on the surface of the image bearing member 21.

The recording medium P is conveyed by the conveyance roller 13*a* to pass a site between the image bearing member 21 and the transfer section 14. At this time, a bias (voltage) is applied to the transfer section 14. As a result, the toner image formed on the image bearing member 21 as described above is transferred to the recording medium P.

The fixing section 30 applies at least one of heat and pressure to the toner image to fix the toner image on the recording medium P. Through the above, an image is formed on the recording medium P. The recording medium P with the image formed thereon is ejected to the ejection section 17 by the ejection roller 16.

Note that after transfer of the toner image from the image bearing member 21 to the recording medium P, toner T remaining on the surface of the image bearing member 21 is removed by the cleaner 26. The image forming apparatus 100 may further include a static eliminator for removing residual charge from the surface of the image bearing member 21.

The following further describes the fixing section 30 in more detail with reference to FIG. 5. FIG. 5 illustrates an example of the fixing section 30 illustrated in FIG. 4.

The fixing section 30 includes a fixing belt 31, a pressure roller 32, a holding member 33, a nip forming member 34, a guide plate 35, a conveyance guide 37, a separation plate 38, and a plurality of (for example, two) induction coils 39. Note that the fixing section 30 may include a fixing roller in place of the fixing belt 31.

The fixing belt 31 has a substantially hollow cylindrical shape elongate in a width direction perpendicular to a conveyance direction of the recording medium P (hereinafter will be simply referred to as a "width direction"). The holding member 33 is disposed inside the fixing belt 31. The fixing belt 31 is supported by the holding member 33, the nip forming member 34, and the guide plate 35 so as to be rotatable about a rotation axis extending in the width direction.

The pressure roller 32 has a substantially hollow cylindrical shape elongate in the width direction. The pressure roller 32 is held in pressure contact with the fixing belt 31 by a pressure mechanism (not illustrated) to form a nip part 36 between the fixing belt 31 and the pressure roller 32. The pressure roller 32 is rotatably supported by a fixing frame (not illustrated). The pressure roller 32 is driven by a driving mechanism (not illustrated) to rotate.

In fixing the toner T to the recording medium P, a high-frequency current is applied to the induction coils 39. Upon application of the high-frequency current, a magnetic field is generated by the induction coils 39 and an eddy current is generated in the fixing belt 31 by an effect of the magnetic field. Through the above, heat is emitted from the fixing belt 31. That is, the fixing belt 31 is heated by the induction coils 39. Heat is also emitted from the guide plate 35 by the effect of the magnetic field, and the fixing belt 31 is also heated by the guide plate 35.

The following further describes the fixing section 30 in more detail with reference to FIG. 2 again. FIG. 2 schematically illustrates the fixing belt 31 and the pressure roller 32 included in the fixing section 30 illustrated in FIG. 5. The fixing belt 31 includes a first base layer 311, a first elastic layer 312, and a first release layer 313. The pressure roller 32 includes a core 321, a second elastic layer 322, and a second release layer 323. The fixing belt 31 and the pressure roller 32 form the nip part 36 therebetween. The recording medium P passes through the nip part 36.

The first base layer 311 of the fixing belt 31 is an endless belt. The first elastic layer 312 is disposed on the first base layer 311. The first release layer 313 is disposed on the first elastic layer 312. The first base layer 311 is formed from a metal subjected to plating or rolling (specific examples include nickel electroforming and copper), for example. The first elastic layer 312 is formed from a silicone rubber, for example. The first release layer 313 is formed from a fluororesin, for example.

The core 321 of the pressure roller 32 has a hollow cylindrical shape. The second elastic layer 322 covers the core 321. The second release layer 323 covers the second elastic layer 322. The core 321 is formed from a metal such as stainless steel or aluminum, for example. The second elastic layer 322 is an elastic member formed from a silicone rubber or a silicone sponge, for example. The second release layer 323 is formed from a fluororesin, for example.

The fixing section 30 can have a fluororesin layer on a surface thereof. Specifically, the first release layer 313 constituting the outer surface of the fixing belt 31 may be a fluororesin layer. In a configuration in which the fixing belt 31 has the fluororesin layer, the fixing belt 31 tends to be negatively charged through friction. However, through use of the toner T according to the present embodiment, the composite particle layer CP containing the composite particles 4 is formed on the surface of the fixing belt 31, as described above. As a result, the fixing belt 31 tends not to be negatively charged through friction and occurrence of offset can be inhibited.

A fluororesin is a resin containing fluorine atoms. Examples of fluororesins include polyvinyl fluoride, polyvinylidene fluoride, polytetrafluoroethylene (PTFE), polytrifluoroethylenes (specific examples include polychlorotrifluoroethylene), polyhexafluoropropylene, tetrafluoroethylene-hexafluoropropylene copolymer (FEP), and tetrafluoroethylene-perfluoroalkylvinylether copolymer (PFA).

In an image forming method using the toner T according to the present embodiment, the shell layers 3 (see FIG. 1) of the toner particles 1 (see FIG. 1) included in the toner T that constitutes an unfixed toner image T1 and that has not yet been fixed are fractured by the fixing section 30 in the fixing step. As a result, the composite particles 4 (see FIG. 1) contained in the toner cores 2 (see FIG. 1) are attached to the surface of the fixing section 30. Specifically, the pressure roller 32 is driven by the driving mechanism (not illustrated) to rotate. Upon driving of the pressure roller 32, the fixing belt 31 in pressure contact with the pressure roller 32 is rotated in accompaniment with rotation of the pressure roller 32. The fixing belt 31 slides on the nip forming member 34 (see FIG. 5) while being rotated. When the recording medium P enters the nip part 36 in the above state, the unfixed toner image T1 on the recording medium P comes into contact with the heated fixing belt 31. As a result, the toner T constituting the unfixed toner image T1 melts and receives pressure. Through the above, the shell layers 3 of the toner particles 1 constituting the unfixed toner image T1 are fractured by the fixing belt 31 and the pressure roller 32. As a result, the composite particles 4 contained in the toner cores 2 are attached to the surface of the fixing belt 31 to form the composite particle layer CP. As a result of formation of the composite particle layer CP on the surface of the fixing belt 31, the fixing belt 31 tends not to be negatively charged through friction and occurrence of offset can be inhibited as described above.

Also, after the shell layers 3 are fractured by the fixing belt 31 and the pressure roller 32, the toner T constituting the unfixed toner image T1 is fixed to the recording medium P. As a result, a fixed toner image T2 is formed from the fixed toner T on the recording medium P. The recording medium P passed through the nip part 36 is separated from the fixing belt 31 by the separation plate 38 (see FIG. 5) and ejected to the outside of the fixing section 30. Through the above, the image forming apparatus 100 accommodating the toner T according to the present embodiment and the image forming method using the toner T according to the present embodiment have been described.

As described above, through use of the toner T according to the present embodiment, occurrence of an image defect such as toner scattering can be inhibited while occurrence of offset due to attachment of the toner T to the fixing section 30 can be inhibited. Also, through use of the image forming apparatus accommodating the toner T according to the present embodiment and the image forming method using the toner T according to the present embodiment, occurrence of an image defect such as toner scattering can be inhibited while occurrence of offset due to attachment of the toner T to the fixing section 30 can be inhibited.

EXAMPLES

The following more specifically describes the present disclosure using examples. However, the present disclosure is by no means limited to the scope of the examples. Table 1 shows compositions of toners A-1 to A-7 according to Examples and toners B-1 to B-6 according to Comparative Examples.

TABLE 1

| | | Composite particle | | | | | | Ratio [wt %] | | | |
|---|---|---|---|---|---|---|---|---|---|---|---|
| | Toner | Type | ECP | Dopant | First releasing agent | Location | Shell layer | Dopant/ ECP | ECP/ Composite particles | ECP/ Toner cores | Composite particles/ Toner cores |
| Example 1 | A-1 | CP-1 | PEDOT | PSS | WAX | Inside core | Yes | 10 | 52.6 | 3.9 | 7.5 |
| Example 2 | A-2 | CP-1 | PEDOT | PSS | WAX | inside core | Yes | 10 | 52.6 | 2.0 | 3.8 |
| Example 3 | A-3 | CP-1 | PEDOT | PSS | WAX | Inside core | Yes | 10 | 52.6 | 0.4 | 0.8 |
| Example 4 | A-4 | CP-1 | PEDOT | PSS | WAX | Inside core | Yes | 10 | 52.6 | 7.9 | 15.0 |
| Example 5 | A-5 | CP-2 | Polyaniline | PSS | WAX | Inside core | Yes | 10 | 66.7 | 5.0 | 7.5 |
| Example 6 | A-6 | CP-3 | PEDOT | PSS | WAX | Inside core | Yes | 5 | 54.1 | 4.1 | 7.5 |
| Example 7 | A-7 | CP-4 | PEDOT | PSS | WAX | Inside core | Yes | 20 | 50.0 | 3.8 | 7.5 |
| Comparative Example 1 | B-1 | — | — | — | — | — | Yes | — | — | — | — |
| Comparative Example 2 | B-2 | CP-5 | PEDOT | PSS | WAX | Inside core | Yes | 10 | 71.4 | 14.3 | 20.0 |
| Comparative Example 3 | B-3 | CP-1 | PEDOT | PSS | WAX | Inside core | No | 10 | 37.0 | 2.8 | 7.5 |
| Comparative Example 4 | B-4 | CP-6 | PEDOT | — | WAX | Inside core | Yes | — | 55.6 | 4.2 | 7.5 |
| Comparative Example 5 | B-5 | CP-7 | PEDOT | PSS | — | Inside core | Yes | 10 | 66.7 | 1.8 | 2.8 |
| Comparative Example 6 | B-6 | CP-8 | PEDOT | PSS | — | Outside core | Yes | 10 | 66.7 | 3.5 | 5.3 |

In Table 1, "PEDOT" represents poly(3,4-ethylenedioxythiophene), "PSS" represents polystyrene sulfonic acid, "WAX" represents a carnauba wax, and "wt %" represents % by mass. In Table 1, "Inside core" indicates that composite particles were located within toner cores. In Table 1, "Outside core" indicates that composite particles were located outside toner cores, specifically, between toner cores and shell layers (at interfaces therebetween), and not located within the toner cores. In Table 1, "Yes" in the column titled "Shell layer" indicates that toner particles each included a shell layer. In Table 1, "No" in the column titled "Shell layer" indicates that toner particles each included no shell layer. In Table 1, "-" in respective columns under "Composite particle" indicates absence of a corresponding component. In Table 1, "-" in respective columns under "Ratio" indicates that a corresponding ratio could not be calculated since a material as a target of calculation of the ratio was not used. Also, "ECP" in Table 1 and in the following description represents "electrically conductive polymer".

In Table 1, values shown in the column titled "Dopant/ECP" each indicate a ratio (unit: % by mass) of the amount of a dopant to the amount of an electrically conductive polymer. The ratio of the amount of the dopant to the amount of the electrically conductive polymer was calculated by the following expression: (100×amount of dopant)/(amount of electrically conductive polymer), that is, (100×solid content of polystyrene sulfonic acid)/(amount of 3,4-ethylenedioxythiophene or polyaniline). Note that respective amounts are amounts of corresponding materials added.

In Table 1, values shown in the column titled "ECP/Composite particles" each indicate a ratio (unit: % by mass)

of the amount of an electrically conductive polymer to the amount of composite particles. The ratio of the amount of the electrically conductive polymer to the amount of the composite particles was calculated by the following expression: (100×amount of electrically conductive polymer)/(amount of electrically conductive polymer+amount of dopant+amount of first releasing agent+amount of curing agent), that is, (100×amount of 3,4-ethylenedioxythiophene or polyaniline)/(amount of 3,4-ethylenedioxythiophene or polyaniline+solid content of polystyrene sulfonic acid+amount of carnauba wax+amount of imidazole). Note that respective amounts are amounts of corresponding materials added.

In Table 1, values shown in the column titled "ECP/Toner cores" each indicate a ratio (unit: % by mass) of the amount of an electrically conductive polymer to the amount of toner cores. The ratio of the amount of the electrically conductive polymer to the amount of the toner cores was calculated by the following expression: (100×amount of electrically conductive polymer)/(amount of toner cores), that is, [100×amount of composite particles added in toner core formation process×(ratio of amount of electrically conductive polymer to amount of composite particles/100)]/(total amount of toner core materials). The total amount of toner core materials is a total of amounts of respective materials shown in any of Toner Core Materials 1 to 8 described below. For example, the total amount of toner core materials 1 is 100.00 parts by mass (that is, equivalent to "amount of first polyester resin (62.50 parts by mass)+amount of second polyester resin (9.00 parts by mass)+amount of third polyester resin (12.00 parts by mass)+amount of composite particles CP-1 (7.50 parts by mass)+amount of carnauba wax (3.00 parts by mass)+amount of colorant (6.00 parts by mass)"). Note that respective amounts are amounts of corresponding materials added.

In Table 1, values shown in the column titled "Composite particles/Toner cores" each indicate a ratio (unit: % by mass) of the amount of composite particles to the mass of toner cores. The ratio of the amount of the composite particles to the mass of the toner cores was calculated by the following expression: (100×amount of composite particles)/(amount of toner cores), that is, (100×amount of composite particles added in toner core formation process)/(total amount of toner core materials). The total amount of toner core materials is a total of amounts of respective materials shown in any of Toner Core Materials 1 to 8 described below. For example, the total amount of the toner core materials 1 is 100.00 parts by mass (that is, equivalent to "amount of first polyester resin (62.50 parts by mass)+amount of second polyester resin (9.00 parts by mass)+amount of third polyester resin (12.00 parts by mass)+amount of composite particles CP-1 (7.50 parts by mass)+amount of carnauba wax (3.00 parts by mass)+amount of colorant (6.00 parts by mass)"). Note that respective amounts are amounts of corresponding materials added.

The following describes methods for producing composite particles CP-1 to CP-8 used in production of respective toners. Also, production methods, evaluation methods, and evaluation results for the toners A-1 to A-7 and B-1 to B-6 will be described. Note that in evaluation in which errors might occur, an appropriate number of measurement values were obtained and an arithmetic mean of the measurement values was determined as an evaluation value so that any errors were sufficiently small.

[Composite Particle Production Methods]

Composite particles were produced by the following methods.

<Production of Composite Particles CP-1>

First, 100.0 g of p-toluenesulfonic acid iron(III) (product of Bayer AG) and 4.0 g of imidazole (product of Sigma-Aldrich Corporation) were dissolved in 700.0 g of butanol to obtain a solution. Then, 10.0 g of 3,4-ethylenedioxythiophene (product of Sigma-Aldrich Corporation) was added to the solution. Directly after the addition of 3,4-ethylenedioxythiophene, 5.0 g of an aqueous polystyrene sulfonic acid solution (solid concentration: 20 wt %, product of Sigma-Aldrich Corporation) was further added to the solution. The amount of polystyrene sulfonic acid added was 1.0 g (that is, amount of aqueous polystyrene sulfonic acid solution of 5.0 g×solid concentration of 20 wt %/100). Then, 4.0 g of a carnauba wax ("CARNAUBA WAX No. 1" manufactured by S. Kato & Co.) heated to 90° C. was further added to the solution. The solution was heated in a water bath at a water temperature of 90° C. for 15 minutes. The solution was cooled to room temperature (25° C.) and then dried. Through the above, a solid was obtained. The solid was washed with purified water and moisture in the solid was then removed using a vacuum dryer. The solid from which moisture had been removed was pulverized using a pulverizer ("ROTOPLEX (registered Japanese trademark)" manufactured by Hosokawa Micron Corporation). Through the above, the composite particles CP-1 were obtained. The composite particles CP-1 were particles of a composite of a first releasing agent (specifically, the carnauba wax), an electrically conductive polymer (specifically, PEDOT), a dopant (specifically, polystyrene sulfonic acid), and a curing agent (specifically, imidazole).

<Production of Composite Particles CP-2>

First, 10.0 g of polyaniline (product of Sigma-Aldrich Corporation) and 1.0 g of polystyrene sulfonic acid (a powder at a solid concentration of 100 wt %, product of Sigma-Aldrich Corporation) were added to 500.0 g of N-methylpyrrolidone (product of Sigma-Aldrich Corporation) to obtain a solution. Then, 4.0 g of a carnauba wax ("CARNAUBA WAX No. 1" manufactured by S. Kato & Co.) heated to 90° C. was added to the solution. The solution was heated in a water bath at a water temperature of 90° C. for 15 minutes. The solution was cooled to room temperature (25° C.) and then filtered to collect a solid. The solid was washed with purified water and moisture in the solid was then removed using a vacuum dryer. The solid from which moisture had been removed was pulverized using a pulverizer ("ROTOPLEX (registered Japanese trademark)" manufactured by Hosokawa Micron Corporation). Through the above, the composite particles CP-2 were obtained. The composite particles CP-2 were particles of a composite of a first releasing agent (specifically, the carnauba wax), an electrically conductive polymer (specifically, polyaniline), and a dopant (specifically, polystyrene sulfonic acid). The composite particles CP-2 contained no curing agent (specifically, imidazole).

<Production of Composite Particles CP-3>

The composite particles CP-3 were produced by the same method as that for production of the composite particles CP-1 in all aspects other than that the amount of the aqueous polystyrene sulfonic acid solution (solid concentration: 20 wt %, product of Sigma-Aldrich Corporation) was changed from 5.0 g to 2.5 g. The amount of polystyrene sulfonic acid added in production of the composite particles CP-3 was 0.5 g (that is, amount of aqueous polystyrene sulfonic acid solution of 2.5 g×solid concentration of 20 wt %/100).

<Production of Composite Particles CP-4>

The composite particles CP-4 were produced by the same method as that for production of the composite particles CP-1 in all aspects other than that the amount of the aqueous polystyrene sulfonic acid solution (solid concentration: 20 wt %, product of Sigma-Aldrich Corporation) was changed from 5.0 g to 10.0 g. The amount of polystyrene sulfonic acid added in production of the composite particles CP-4 was 2.0 g (that is, amount of aqueous polystyrene sulfonic acid solution of 10.0 g×solid concentration of 20 wt %/100).

<Production of Composite Particles CP-5>

First, 300.0 g of p-toluenesulfonic acid iron(III) (product of Bayer AG) and 12.0 g of imidazole (product of Sigma-Aldrich Corporation) were dissolved in 2100.0 g of butanol to obtain a solution. Then, 30.0 g of 3,4-ethylenedioxythiophene (product of Sigma-Aldrich Corporation) was added to the solution. Directly after the addition of 3,4-ethylenedioxythiophene, 15.0 g of an aqueous polystyrene sulfonic acid solution (solid concentration: 20 wt %, product of Sigma-Aldrich Corporation) was further added to the solution. The amount of polystyrene sulfonic acid added was 3.0 g (that is, amount of aqueous polystyrene sulfonic acid solution of 15.0 g×solid concentration of 20 wt %/100). Then, 5.0 g of a carnauba wax ("CARNAUBA WAX No. 1" manufactured by S. Kato & Co.) heated to 90° C. was further added to the solution. The solution was heated in a water bath at a water temperature of 90° C. for 15 minutes. The solution was cooled to room temperature (25° C.) and then dried. Through the above, a solid was obtained. The solid was washed with purified water and moisture in the solid was then removed using a vacuum dryer. The solid from which moisture had been removed was pulverized using a pulverizer ("ROTOPLEX (registered Japanese trademark)" manufactured by Hosokawa Micron Corporation). Through the above, the composite particles CP-5 were obtained. The composite particles CP-5 were particles of a composite of a first releasing agent (specifically, the carnauba wax), an electrically conductive polymer (specifically, PEDOT), a dopant (specifically, polystyrene sulfonic acid), and a curing agent (specifically, imidazole).

<Production of Composite Particles CP-6>

The composite particles CP-6 were produced by the same method as that for production of the composite particles CP-1 in all aspects other than that the aqueous polystyrene sulfonic acid solution was not added. The composite particles CP-6 were particles of a composite of a first releasing agent (specifically, the carnauba wax), an electrically conductive polymer (specifically, PEDOT), and a curing agent (specifically, imidazole). The composite particles CP-6 contained no dopant (specifically, polystyrene sulfonic acid).

<Production of Composite Particles CP-7>

First, 100.0 g of p-toluenesulfonic acid iron(III) (product of Bayer AG) and 4.0 g of imidazole (product of Sigma-Aldrich Corporation) were dissolved in 700.0 g of butanol to obtain a solution. Then, 10.0 g of 3,4-ethylenedioxythiophene (product of Sigma-Aldrich Corporation) was added to the solution. Directly after the addition of 3,4-ethylenedioxythiophene, 5.0 g of an aqueous polystyrene sulfonic acid solution (solid concentration: 20 wt %, product of Sigma-Aldrich Corporation) was further added to the solution. The amount of polystyrene sulfonic acid added was 1.0 g (that is, amount of aqueous polystyrene sulfonic acid solution of 5.0 g×solid concentration of 20 wt %/100). Then, the solution was dried at room temperature (25° C.). Through the above, a solid was obtained. The solid was washed with purified water and moisture in the solid was then removed using a vacuum dryer. The solid from which moisture had been removed was pulverized using a pulverizer ("ROTOPLEX (registered Japanese trademark)" manufactured by Hosokawa Micron Corporation). Through the above, the composite particles CP-7 were obtained. The composite particles CP-7 were particles of a composite of an electrically conductive polymer (specifically, PEDOT), a dopant (specifically, polystyrene sulfonic acid), and a curing agent (specifically, imidazole). The composite particles CP-7 contained no first releasing agent (specifically, carnauba wax).

<Production of Composite Particles CP-8>

First, 100.0 g of p-toluenesulfonic acid iron(III) (product of Bayer AG) and 4.0 g of imidazole (product of Sigma-Aldrich Corporation) were dissolved in 700.0 g of butanol to obtain a solution. Then, 10.0 g of 3,4-ethylenedioxythiophene (product of Sigma-Aldrich Corporation) was added to the solution. Directly after the addition of 3,4-ethylenedioxythiophene, 5.0 g of an aqueous polystyrene sulfonic acid solution (solid concentration: 20 wt %, product of Sigma-Aldrich Corporation) was further added to the solution. The amount of polystyrene sulfonic acid added was 1.0 g (that is, amount of aqueous polystyrene sulfonic acid solution of 5.0 g×solid concentration of 20 wt %/100). The solution was heated in a water bath at a water temperature of 90° C. for 15 minutes. The solution was cooled to room temperature (25° C.) and then dried. Through the above, a solid was obtained. The solid was washed with purified water and moisture in the solid was then removed using a vacuum dryer. The solid from which moisture had been removed was crushed into a powder using a mortar and a pestle. Through the above, the composite particles CP-8 were obtained. The composite particles CP-8 were particles of a composite of an electrically conductive polymer (specifically, PEDOT), a dopant (specifically, polystyrene sulfonic acid), and a curing agent (specifically, imidazole). The composite particles CP-8 contained no first releasing agent (specifically, carnauba wax).

[Toner Production Methods]

<Production of Toner A-1>

The toner A-1 was produced by the following method.

(Toner Core Formation Process)

Toner core materials in amounts and of types shown below in "Toner Core Materials 1" were loaded into an FM mixer. Note that the first polyester resin had low viscosity, the second polyester resin had medium viscosity, and the third polyester resin had high viscosity.

<<Toner Core Materials 1>>

First polyester resin (Tg: 38° C., Tm: 65° C.): 62.50 parts by mass

Second polyester resin (Tg: 53° C., Tm: 84° C.): 9.00 parts by mass

Third polyester resin (Tg: 71° C., Tm: 120° C.): 12.00 parts by mass

Composite particles CP-1: 7.50 parts by mass

Second releasing agent (carnauba wax, "CARNAUBA WAX No. 1" manufactured by S. Kato & Co.): 3.00 parts by mass Colorant (Phthalocyanine Blue, "KET BLUE 111" manufactured by DIC Corporation): 6.00 parts by mass The toner core materials were mixed using the FM mixer at a rotational speed of 2,400 rpm to obtain a mixture. The mixture was kneaded while being melted using a twin-screw extruder under conditions of a material feeding rate of 5 kg/hour, a shaft rotational speed of 160 rpm, and a set temperature of 105° C. to obtain a kneaded product. The kneaded product was cooled. The cooled kneaded product was subjected to primary pulverization using a pulverizer ("ROTOPLEX (registered Japanese trademark)" manufactured by Hosokawa Micron Corporation) to obtain a primary pulverized product. The primary pulverized product was subjected to secondary pulverization using a jet mill ("MODEL-I SUPERSONIC JET MILL" manufactured by Nippon Pneumatic Mfg. Co., Ltd.) to obtain a secondary pulverized product. The secondary pulverized product was classified using a classifier (air classifier utilizing the Coanda effect, "ELBOW JET TYPE EJ-LABO" manufactured by Nittetsu Mining Co., Ltd.) to obtain toner cores.

(Resin Particle Suspension Preparation Process)

Next, a resin particle suspension that was a shell material was prepared. Specifically, a 2-L three-necked flask equipped with a thermometer and a stirring impeller was charged with 875 mL of ion exchanged water and 75 mL of an anionic surfactant ("LATEMUL (registered Japanese trademark) WX" manufactured by Kao Corporation, component: polyoxyethylene alkyl ether sodium sulfate, solid concentration: 26% by mass). The internal temperature of the flask was increased up to 80° C. using a water bath. A liquid (A) was dripped into the flask over 5 hours. The liquid (A) was a liquid mixture of 17 mL of styrene and 3 mL of butyl acrylate. Simultaneously with dripping of the liquid (A), a liquid (B) was also dripped into the flask over 5 hours. The liquid (B) was a solution of 0.5 g of potassium peroxodisulfate dissolved in 30 mL of ion exchanged water. After completion of dripping of the liquids (A) and (B), the flask contents were kept at 80° C. for 2 hours. Through the above, polymerization was completed, and the resin particle suspension was obtained. A number average particle diameter of resin particles included in the obtained resin particle suspension was measured using a transmission electron microscope and found to be 32 nm. Tg of the resin particles included in the resin particle suspension was measured using a differential scanning calorimeter and found to be 71° C. The resin particles included in the resin particle suspension were particles of a styrene-acrylic acid-based resin (specifically, a copolymer of styrene and butyl acrylate).

(Shell Layer Formation Process)

A 2-L three-necked flask equipped with a thermometer and a stirring impeller was charged with 300 mL of ion exchanged water. The temperature of the flask content was kept at 30° C. using a water bath. Then, dilute hydrochloric acid was added into the flask to adjust pH of the aqueous medium within the flask to 4. After the pH adjustment, 30 mL of the shell material (specifically, the resin particle suspension prepared through the resin particle suspension preparation process) was added into the flask and dissolved in the aqueous medium, whereby an aqueous solution (C) of the shell material was obtained. Then, 300 g of the toner cores was added to the aqueous solution (C) within the flask. The flask contents were stirred at 200 rpm for 1 hour. Then, 300 mL of ion exchanged water was added into the flask. The temperature of the flask contents was increased from 30° C. up to 70° C. at a rate of 1° C./minute while the flask contents were stirred at 100 rpm. Once the temperature of the flask contents reached 35° C. midway through heating, an aqueous sodium hydroxide solution was added into the flask to adjust pH of the aqueous medium within the flask to 7. After the temperature of the flask contents was increased up to 70° C., the flask contents were cooled to room temperature. Through the above, a dispersion including toner particles was obtained.

(Washing Process)

The dispersion including the toner particles was filtered using a Buchner funnel to collect a wet cake of the toner particles. The wet cake of the toner particles was dispersed in ion exchanged water to wash the toner particles. Washing of the toner particles was repeated five times. Through the above, a wet cake of the washed toner particles was obtained.

(Drying Process)

The wet cake of the toner particles obtained through the washing process was dispersed in a 50% by mass aqueous ethanol solution to obtain a slurry. The slurry was supplied to a continuous type surface modifier ("COATMIZER (registered Japanese trademark)" manufactured by Freund Corporation). Through the above, the toner particles included in the slurry were dried to obtain dry toner particles. Drying using COATMIZER was performed under conditions of a hot air temperature of 45° C. and a blower flow rate of 2 $m^3$/minute.

(External Additive Addition Process)

First, 100.0 parts by mass of the toner particles obtained through the drying process, 2.0 parts by mass of hydrophobic silica particles ("AEROSIL (registered Japanese trademark) RA-200H" manufactured by Nippon Aerosil Co., Ltd., content: dry silica particles surface modified with a trimethylsilyl group and an amino group, BET specific surface area: approximately 150 $m^2$/g, number average primary particle diameter: approximately 12 nm), and 1.5 parts by mass of conductive titanium oxide particles ("EC-100" manufactured by Titan Kogyo, Ltd., base: $TiO_2$ particles, coat layers: Sb-doped $SnO_2$ layers) were mixed together for 5 minutes using an FM mixer ("FM-10B" manufactured by Nippon Coke & Engineering Co., Ltd.). Through the above, external additives were attached to surfaces of the toner particles. The toner particles with the external additives attached thereto were sifted using a 200-mesh sieve (pore size: 75 μm), whereby the toner A-1 was obtained. The toner A-1 was a collection (powder) of a large number of the toner particles with the external additives attached thereto.

<Production of Toner A-2>

The toner A-2 was produced by the same method as that for production of the toner A-1 in all aspects other than that toner core materials 2 shown below were used in place of the toner core materials 1.

<<Toner Core Materials 2>>

First polyester resin (Tg: 38° C., Tm: 65° C.): 63.25 parts by mass

Second polyester resin (Tg: 53° C., Tm: 84° C.): 10.00 parts by mass

Third polyester resin (Tg: 71° C., Tm: 120° C.): 13.00 parts by mass

Composite particles CP-1: 3.75 parts by mass

Second releasing agent (carnauba wax, "CARNAUBA WAX No. 1" manufactured by S. Kato & Co.): 4.00 parts by mass Colorant (Phthalocyanine Blue, "KET BLUE 111" manufactured by DIC Corporation): 6.00 parts by mass <Production of Toner A-3>

The toner A-3 was produced by the same method as that for production of the toner A-1 in all aspects other than that toner core materials 3 shown below were used in place of the toner core materials 1.

<<Toner Core Materials 3>>

First polyester resin (Tg: 38° C., Tm: 65° C.): 64.00 parts by mass

Second polyester resin (Tg: 53° C., Tm: 84° C.): 10.45 parts by mass

Third polyester resin (Tg: 71° C., Tm: 120° C.): 14.00 parts by mass

Composite particles CP-1: 0.75 parts by mass

Second releasing agent (carnauba wax, "CARNAUBA WAX No. 1" manufactured by S. Kato & Co.): 4.80 parts by mass Colorant (Phthalocyanine Blue, "KET BLUE 111" manufactured by DIC Corporation): 6.00 parts by mass <Production of Toner A-4>

The toner A-4 was produced by the same method as that for production of the toner A-1 in all aspects other than that toner core materials 4 shown below were used in place of the toner core materials 1.

<<Toner Core Materials 4>>

First polyester resin (Tg: 38° C., Tm: 65° C.): 61.00 parts by mass

Second polyester resin (Tg: 53° C., Tm: 84° C.): 7.00 parts by mass

Third polyester resin (Tg: 71° C., Tm: 120° C.): 10.00 parts by mass

Composite particles CP-1: 15.00 parts by mass

Second releasing agent (carnauba wax, "CARNAUBA WAX No. 1" manufactured by S. Kato & Co.): 1.00 part by mass Colorant (Phthalocyanine Blue, "KET BLUE 111" manufactured by DIC Corporation): 6.00 parts by mass <Production of Toner A-5>

The toner A-5 was produced by the same method as that for production of the toner A-1 in all aspects other than that the composite particles CP-2 (7.50 parts by mass) were used in place of the composite particles CP-1 (7.50 parts by mass).

<Production of Toner A-6>

The toner A-6 was produced by the same method as that for production of the toner A-1 in all aspects other than that the composite particles CP-3 (7.50 parts by mass) were used in place of the composite particles CP-1 (7.50 parts by mass).

<Production of Toner A-7>

The toner A-7 was produced by the same method as that for production of the toner A-1 in all aspects other than that the composite particles CP-4 (7.50 parts by mass) were used in place of the composite particles CP-1 (7.50 parts by mass).

<Production of Toner B-1>

The toner B-1 was produced by the same method as that for production of the toner A-1 in all aspects other than that toner core materials 5 shown below were used in place of the toner core materials 1. As indicated by the toner core materials 5 below, composite particles were not used in production of toner cores of the toner B-1.

<<Toner Core Materials 5>>

First polyester resin (Tg: 38° C., Tm: 65° C.): 64.00 parts by mass

Second polyester resin (Tg: 53° C., Tm: 84° C.): 11.00 parts by mass

Third polyester resin (Tg: 71° C., Tm: 120° C.): 14.00 parts by mass

Second releasing agent (carnauba wax, "CARNAUBA WAX No. 1" manufactured by S. Kato & Co.): 5.00 parts by mass Colorant (Phthalocyanine Blue, "KET BLUE 111" manufactured by DIC Corporation): 6.00 parts by mass <Production of Toner B-2>

The toner B-2 was produced by the same method as that for production of the toner A-1 in all aspects other than that toner core materials 6 shown below were used in place of the toner core materials 1.

<<Toner Core Materials 6>>

First polyester resin (Tg: 38° C., Tm: 65° C.): 59.00 parts by mass

Second polyester resin (Tg: 53° C., Tm: 84° C.): 5.00 parts by mass

Third polyester resin (Tg: 71° C., Tm: 120° C.): 10.00 parts by mass

Composite particles CP-5: 20.00 parts by mass

Colorant (Phthalocyanine Blue, "KET BLUE 111" manufactured by DIC Corporation): 6.00 parts by mass <Production of Toner B-3>

The toner B-3 was produced by the same method as that for production of the toner A-1 in all aspects other than that the resin particle suspension preparation process, the shell layer formation process, the washing process, and the drying process were not performed. Since the shell layer formation process was not performed, toner particles of the toner B-3 included no shell layer.

<Production of Toner B-4>

The toner B-4 was produced by the same method as that for production of the toner A-1 in all aspects other than that toner core materials 7 shown below were used in place of the toner core materials 1.

<<Toner Core Materials 7>>

First polyester resin (Tg: 38° C., Tm: 65° C.): 63.00 parts by mass

Second polyester resin (Tg: 53° C., Tm: 84° C.): 9.00 parts by mass

Third polyester resin (Tg: 71° C., Tm: 120° C.): 12.00 parts by mass

Composite particles CP-6 (containing no dopant): 7.50 parts by mass

Second releasing agent (carnauba wax, "CARNAUBA WAX No. 1" manufactured by S. Kato & Co.): 2.50 parts by mass Colorant (Phthalocyanine Blue, "KET BLUE 111" manufactured by DIC Corporation): 6.00 parts by mass <Production of Toner B-5>

The toner B-5 was produced by the same method as that for production of the toner A-1 in all aspects other than that toner core materials 8 shown below were used in place of the toner core materials 1.

<<Toner Core Materials 8>>

First polyester resin (Tg: 38° C., Tm: 65° C.): 63.25 parts by mass

Second polyester resin (Tg: 53° C., Tm: 84° C.): 10.00 parts by mass

Third polyester resin (Tg: 71° C., Tm: 120° C.): 13.00 parts by mass

Composite particles CP-7 (containing no first releasing agent): 2.75 parts by mass Second releasing agent (carnauba wax, "CARNAUBA WAX No. 1" manufactured by S. Kato & Co.): 5.00 parts by mass Colorant (Phthalocyanine Blue, "KET BLUE 111" manufactured by DIC Corporation): 6.00 parts by mass <Production of Toner B-6>

Toner cores of the toner B-6 were prepared by the same method as that for preparation of the toner cores of the toner B-1. No composite particles were used in preparation of the toner cores of the toner B-6. Then, 95 parts by mass of the toner cores and 5 parts by mass of the composite particles CP-8 (containing no first releasing agent and finely pulverized) were mixed together using an FM mixer ("FM-10B" manufactured by Nippon Coke & Engineering Co., Ltd.). Through the above, the composite particles CP-8 were attached to surfaces of the toner cores. Next, a shell layer formation process was performed in the same manner as that in production of the toner A-1 in all aspects other than that the toner cores (300 g) with the composite particles CP-8 attached thereto were used in place of the toner cores (300 g) used in the shell layer formation process in production of the toner A-1. Then, a washing process, a drying process, and an external additive addition process were performed in the same manner as those in production of the toner A-1. Through the above, the toner B-6 was obtained. Toner particles of the toner B-6 each included a toner core having a surface covered with a layer formed from the composite particles CP-8. A surface of the layer formed from the composite particles CP-8 was covered with a shell layer. That is, the layer formed from the composite particles CP-8 was disposed on the surface of each toner core, and the shell layer was disposed on the surface of the layer formed from the composite particles CP-8. In each of the toner particles included in the toner B-6, the composite particles CP-8 were located between the toner core and the shell layer (at an interface therebetween), and no composite particle CP-8 was located within the toner core.

[Evaluation Methods]

Each of samples (the toners A-1 to A-7 and B-1 to B-6) was evaluated by the following methods.

First, a two-component developer to be used for evaluation was prepared. Specifically, 100 parts by mass of a carrier for a color multifunction peripheral ("TASKalfa 8052ci" manufactured by KYOCERA Document Solutions Inc.) and 10 parts by mass of a toner (any of the toners A-1 to A-7 and B-1 to B-6) were mixed to obtain an evaluation two-component developer.

<Evaluation of Offset Resistance>

Offset resistance was evaluated through image formation with the evaluation two-component developer. Evaluation was performed in an environment at a temperature of 32.5° C. and a relative humidity of 80%. An evaluation apparatus used was a modified machine of a color multifunction peripheral ("TASKalfa 8052ci" manufactured by KYOCERA Document Solutions Inc.). The modified machine was prepared by removing a charger provided for a fixing belt from the multifunction peripheral. The fixing belt had a fluororesin layer as a surface layer thereof. The fixing temperature of the fixing belt was set to 160° C. The development bias of a development section was adjusted to 250 V. The evaluation two-component developer was loaded into a development section (development device) for cyan color in the evaluation apparatus. Also, a toner for replenishment use was loaded into a toner accommodation section (toner container) for cyan color in the evaluation apparatus. The toner for replenishment use was the same toner as that included in the evaluation two-component developer. That is, the toner for replenishment use was any of the toners A-1 to A-7 and B-1 to B-6.

(Evaluation of Initial Offset Resistance)

An image I was printed on 10 sheets of paper (A3 size plain paper) using the evaluation apparatus. The image I included a patch image region and a blank image region. The patch image region was a region corresponding to an image fixed in the first turn of the fixing belt. The blank image region was a region corresponding to an image fixed in the second turn of the fixing belt. The patch image region included five patch image portions. The five patch image portions were patch image portions A, B, C, D, and E. Each of the patch image portions A, B, C, D, and E had a size of 3 cm×2 cm. The patch image portions A, B, C, D, and E were printed on the paper so as to be arranged in a direction perpendicular to a conveyance direction of the paper in the stated order from the left end of the paper. The patch image portions A, B, C, D, and E were printed with toner application amounts of 1.0 mg/cm$^2$, 0.8 mg/cm$^2$, 0.6 mg/cm$^2$, 0.4 mg/cm$^2$, and 0.2 mg/cm$^2$, respectively.

With respect to each of the 10 sheets of paper with the image I printed thereon, a fogging density (FD) of the blank image region was measured. FD of the blank image region was measured using a fully automatic brightness meter ("TC-6DSA" manufactured by Tokyo Denshoku Co., Ltd.). FD of the blank image region was calculated by the following expression: FD=(reflection density of blank image region)−(reflection density of unprinted paper). Upon occurrence of offset, toner is attached to the fixing belt in the first turn of the fixing belt. As a consequence, the toner tends to be transferred from the fixing belt and attached to the paper in the second turn of the fixing belt. This results in a high fogging density of the blank image region corresponding to a region of the image fixed in the second turn of the fixing belt.

(Evaluation of Post-Durability Test Offset Resistance)

Next, an image II (a pattern image with a coverage rate of 5%) was printed on 300,000 sheets of paper (A4 size plain paper) using the evaluation apparatus (durability test). After the 300,000-sheet printing, the image I was printed on 10 sheets of paper (A3 size plain paper) using the evaluation apparatus. With respect to each of the 10 sheets of paper with the image I printed thereon, FD of the blank image region was measured by the same method as that for evaluation of initial offset resistance.

(Evaluation Standards for Initial Offset Resistance and Post-Durability Test Offset Resistance)

Initial offset resistance (specifically, offset resistance before the 300,000-sheet printing) and post-durability test offset resistance (specifically, offset resistance after the 300,000-sheet printing) were each evaluated on the basis of the measured FD of the blank image region in accordance with the following standards.

Good: FD was no greater than 0.003.

Poor: FD was greater than 0.003.

<Evaluation of Image Defect>

The 10 sheets of paper with the image I printed thereon obtained in evaluation of post-durability test offset resistance were each visually observed. Presence or absence of an image defect (specific examples include tailing, a void, and toner scattering) in the image I was determined.

<Evaluation of Low-Temperature Fixability>

A minimum fixable temperature of the toner was evaluated through image formation with the evaluation two-component developer. Evaluation was performed in an environment at a temperature of 23° C. and a relative humidity of 50%. An evaluation apparatus used was a modified machine of a printer ("FS-C5250DN" manufactured by KYOCERA Document Solutions Inc., configuration of fixing section: roller-roller type heat and pressure fixing section, nip width in fixing section: 8 mm). The modified machine was prepared by modifying the fixing section of the printer (FS-C5250DN) to enable adjustment of the fixing temperature. The fixing section had a fluororesin layer as a surface layer thereof. The evaluation two-component developer was loaded into a development section (development device) for cyan color in the evaluation apparatus. Also, a toner for replenishment use was loaded into a toner accommodation section (toner container) for cyan color in the evaluation apparatus. The toner for replenishment use was the same toner as that included in the evaluation two-component developer. That is, the toner for replenishment use was any of the toners A-1 to A-7 and B-1 to B-6.

An unfixed solid image (specifically, an unfixed toner image) with a toner application amount of 0.4 mg/cm$^2$ was formed on paper using the evaluation apparatus. Subsequently, the paper with the unfixed solid image formed thereon was passed through the fixing section of the evaluation apparatus. The fixing temperature of the fixing section was increased from 100° C. in increments of 5° C. to determine a lowest temperature (a provisional minimum fixable temperature) at which the unfixed solid image was fixable to the paper. Next, the fixing temperature of the fixing section was increased from the provisional minimum fixable temperature in increments of 1° C. to determine a lowest temperature (a minimum fixable temperature) at which the unfixed solid image was fixable to the paper.

In determination of the minimum fixable temperature, whether or not the toner was fixable was determined by the following fold-rubbing test. The evaluation paper passed through the fixing section was folded in half such that a surface with the image formed thereon faced inwards, and then a 1-kg weight covered with cloth was rubbed on the fold back and forth ten times. Thereafter, the paper was opened up and a folded part (a part in which the solid image had been formed) of the paper was observed. A length of peeling of the toner (peeling length) in the folded part was measured. A lowest temperature among fixing temperatures for which the peeling length was no greater than 1 mm was determined as the minimum fixable temperature (unit: ° C.).

[Evaluation Results]

Table 2 shows results of evaluation of offset resistance, image defect, and low-temperature fixability for each of the toners A-1 to A-7 and B-1 to B-6. In Table 2, "FD" represents "fogging density" and "NG" represents "poor". In Table 2. "Absent" in the column titled "Image defect" indicates that none of tailing, a void, and toner scattering was observed in any of the formed images in evaluation of the image defect. In Table 2, "Present" in the column titled "Image defect" indicates that at least one of tailing, a void, and toner scattering was observed in any of the formed images in evaluation of the image defect. In Table 2, "Unmeasurable" indicates that a fogging density due to occurrence of offset could not be accurately measured since considerable fogging due to toner scattering occurred in the formed images.

TABLE 2

| | | Offset resistance | | | Low-temperature fixability |
|---|---|---|---|---|---|
| | Toner | Initial FD | Post-durability test FD | Image defect | Minimum fixable temperature [° C.] |
| Example 1 | A-1 | 0.001 | 0.000 | Absent | 130 |
| Example 2 | A-2 | 0.001 | 0.001 | Absent | 130 |
| Example 3 | A-3 | 0.002 | 0.001 | Absent | 129 |
| Example 4 | A-4 | 0.000 | 0.000 | Absent | 140 |
| Example 5 | A-5 | 0.001 | 0.001 | Absent | 132 |
| Example 6 | A-6 | 0.002 | 0.002 | Absent | 130 |
| Example 7 | A-7 | 0.001 | 0.001 | Absent | 130 |
| Comparative Example 1 | B-1 | 0.015 (NG) | 0.019 (NG) | Absent | 129 |
| Comparative Example 2 | B-2 | Not fixed | Not fixed | Not fixed | Not fixed |
| Comparative Example 3 | B-3 | 0.001 | 0.001 | Present | 110 |
| Comparative Example 4 | B-4 | 0.013 (NG) | 0.013 (NG) | Absent | 128 |
| Comparative Example 5 | B-5 | 0.013 (NG) | 0.016 (NG) | Absent | 129 |
| Comparative Example 6 | B-6 | Unmeasurable | Unmeasurable | Present | 135 |

As shown in Table 1, toner particles of each of the toners A-1 to A-7 each included a toner core and a shell layer covering a surface of the toner core. The toner core contained composite particles. The composite particles were particles of a composite of a first releasing agent (specifically, the carnauba wax), an electrically conductive polymer (specifically, PEDOT or polyaniline), and a dopant (specifically, PSS). A ratio of the amount of the composite particles to the mass of the toner cores was at least 0.5% by mass and no greater than 15.0% by mass. Therefore, the toners A-1 to A-7 were evaluated as good in evaluation of offset resistance as shown in Table 2. Also, none of tailing, a void, and toner scattering was observed in any of the images formed with the toners A-1 to A-7.

In each of the toners A-1 to A-3 and A-5 to A-7, the ratio of the amount of the composite particles to the mass of the toner cores was at least 0.5% by mass and no greater than 10.0% by mass as shown in Table 1. Therefore, with respect to each of the toners A-1 to A-3 and A-5 to A-7, the minimum fixable temperature was no higher than 132° C. as shown in Table 2. Through use of any of the toners A-1 to A-3 and A-5 to A-7, low-temperature fixability could be improved while occurrence of offset and occurrence of an image defect could be inhibited as compared with use of the toner A-4.

As for the toner B-1, the toner cores contained no composite particles (see Table 1). Therefore, the toner B-1 was poor in offset resistance as shown in Table 2.

As for the toner B-2, the ratio of the amount of the composite particles to the mass of the toner cores was greater than 15.0% by mass (see Table 1). Therefore, in image formation with the toner B-2, an image could not be printed on paper due to failure in fixing of the image on the paper as shown in Table 2. Accordingly, the toner B-2 could not be evaluated in terms of offset resistance, image defect, and low-temperature fixability.

As for the toner B-3, the toner particles included no shell layer (see Table 1). Therefore, an image defect was observed in an image formed with the toner B-3 as shown in Table 2.

As for the toner B-4, the toner cores contained composite particles, but the composite particles contained no dopant (specifically, PSS) (see Table 1). Therefore, the toner B-4 was poor in offset resistance as shown in Table 2.

As for the toner B-5, the toner cores contained composite particles, but the composite particles contained no first releasing agent (specifically, carnauba wax) (see Table 1). Therefore, the toner B-5 was poor in offset resistance as shown in Table 2.

As for the toner B-6, the toner cores contained no composite particles. Specifically, composite particles were located outside the toner cores (specifically, between the toner cores and the shell layers). Furthermore, the composite particles contained no first releasing agent (specifically, carnauba wax) (see Table 1). Therefore, an image defect (particularly, toner scattering) was observed in an image formed with the toner B-6 as shown in Table 2. Also, through use of the toner B-6, considerable fogging occurred due to toner scattering. Therefore, a density of fogging caused due to occurrence of offset could not be accurately measured.

The above results indicate that through use of the toner according to the present disclosure encompassing the toners A-1 to A-7, it is possible to inhibit occurrence of offset due to attachment of the toner to the fixing section as well as occurrence of an image defect such as tailing, a void, or toner scattering.

What is claimed is:

1. A toner comprising toner particles, wherein the toner particles each include a toner core and a shell layer covering a surface of the toner core, the toner core contains composite particles, the composite particles are particles of a composite of a releasing agent, an electrically conductive polymer, and a dopant, a ratio of an amount of the composite particles to a mass of the toner cores is at least 0.5% by mass and no greater than 15.0% by mass, and the shell layer does not include the composite particles.

2. The toner according to claim 1, wherein the ratio of the amount of the composite particles to the mass of the toner cores is at least 0.5% by mass and no greater than 10.0% by mass.

3. The toner according to claim 1, wherein the electrically conductive polymer includes polythiophene, a derivative of polythiophene, polyaniline, or a derivative of polyaniline.

4. The toner according to claim 1, wherein the dopant includes polystyrene sulfonic acid.

5. An image forming apparatus comprising:

a toner accommodation section configured to accommodate a toner;

an image bearing member;

a development section configured to develop an electrostatic latent image on the image bearing member into a toner image with the toner supplied from the toner accommodation section;

a transfer section configured to transfer the toner image on the image bearing member onto a recording medium; and a fixing section configured to fix to the recording medium the toner image transferred to the recording medium, wherein the toner is the toner according to claim 1.

6. An image forming method comprising:

developing by a development section an electrostatic latent image on an image bearing member into a toner image with a toner supplied from a toner accommodation section;

transferring by a transfer section the toner image on the image bearing member to a recording medium; and fixing by a fixing section to the recording medium the toner image transferred to the recording medium, wherein the toner is the toner according to claim 1, and in the fixing, the shell layers of the toner particles of the toner forming the toner image are fractured by the fixing section to cause attachment of the composite particles contained in the toner cores to a surface of the fixing section.

* * * * *